US005457282A

United States Patent [19]

Miyamoto et al.

[11] Patent Number: 5,457,282

[45] Date of Patent: Oct. 10, 1995

[54] AUTOMATIC ACCOMPANIMENT APPARATUS HAVING ARRANGEMENT FUNCTION WITH BEAT ADJUSTMENT

[75] Inventors: Hiromu Miyamoto; Tatsuya Nonaka; Keizo Terui; Eiichiro Aoki; Kazunori Maruyama, all of Hamamatsu, Japan

[73] Assignee: Yamaha Corporation, Hamamatsu, Japan

[21] Appl. No.: 174,034

[22] Filed: Dec. 28, 1993

[51] Int. Cl.[6] ..... G10H 1/36

[52] U.S. Cl. ..... 84/634; 84/666

[58] Field of Search ..... 84/609–614, 634–638, 84/649–652, 666–669, 622, DIG. 12, DIG. 22

[56] References Cited

U.S. PATENT DOCUMENTS

| | | | |
|---|---|---|---|
| 5,229,533 | 7/1993 | Sakurai | 84/622 X |
| 5,300,725 | 4/1994 | Manabe | 84/609 |
| 5,340,939 | 8/1994 | Kumagai | 84/609 |

FOREIGN PATENT DOCUMENTS 1283596 11/1989 Japan .

*Primary Examiner*—Stanley J. Witkowski
*Attorney, Agent, or Firm*—Spensley Horn Jubas & Lubitz

[57] ABSTRACT

An accompaniment apparatus has a first memory for memorizing a plurality of original accompaniment patterns corresponding to various accompaniment styles, each original accompaniment pattern being composed of a set of parallel part patterns. An editor is operated for designating different ones of the original accompaniment patterns and collecting therefrom a set of desired part patterns to define a free accompaniment pattern which is different than the original accompaniment patterns. A second memory memorizes designated and collected results by the editor for use in reproduction of the free accompaniment pattern. During the reproduction, a pattern length difference or a meter difference among the set of the collected parallel part patterns can be corrected to maintain a consistent progression of the automatic free accompaniment.

9 Claims, 26 Drawing Sheets

FIG. 10

| Song No.3 | | | | |
|---|---|---|---|---|
| Section | A | B | C | D |
| Measure number | 4 | 4 | 4 | 8 |
| Style code | 3 | 5 | 2 | 4 |
| Beat number | 3/4 | 4/4 | 4/4 | 4/4 |

AUTOMATIC ACCOMPANIMENT APPARATUS HAVING ARRANGEMENT FUNCTION WITH BEAT ADJUSTMENT

BACKGROUND OF THE INVENTION

The present invention relates to an accompaniment registration apparatus and an automatic accompaniment apparatus, suitable for use in an electronic musical instrument or in other applications. More particularly, the invention relates to registration and reproduction of a free accompaniment pattern which is defined by a prescription data effective to designate a set of parallel parts freely collected from different original accompaniment patterns corresponding to various styles.

The conventional electronic musical instrument adopts one type of the automatic accompaniment apparatus having a memory for storing a plurality of original accompaniment patterns corresponding to various styles such as Rock and Waltz. When a desired style is selected, the corresponding accompaniment pattern is reproduced to effect an automatic accompaniment. Each original accompaniment pattern is comprised of a multiple parts such as a chord part and a bass part so that the automatic accompaniment is performed by parallel reproduction of the multiple parts in an orchestral manner. However, the plurality of original accompaniment patterns are provisionally written into the memory by "factory setting". The written original accompaniment pattern is fixed, and is therefore never modified or arranged by a user; hence the reproduced accompaniment is rather plain and not interesting.

Another type of the conventional accompaniment apparatus can register a free accompaniment pattern made by the user. The free accompaniment pattern is reserved in a memory for the automatic accompaniment reproduction. This technology can be applied to the first-mentioned prior art such that the user can compose a desired set of multiple parts of a free accompaniment pattern, which is then registered in a memory for the automatic accompaniment reproduction. However, in such a construction, the user must preset all of the parts for each free accompaniment pattern. Such tedious preset work may disadvantageously require time and labor, as the number of parallel parts increases.

Aside from the above noted prior art, the inventors are presently working with a new type of the automatic accompaniment apparatus provided with an arrangement function effective to select a desired set of individual parts to define a free collective accompaniment pattern, from different original accompaniment patterns each composed of multiple parts such as a chord backing part, a bass part and a rhythm part. The set of selected parts are registered, and concurrently read out in parallel manner with each other to reproduce the free collective accompaniment pattern. However, all the individual parts must be collected from a limited group of original accompaniment patterns having the same pattern length and the same beat number so as to ensure consistency of the free accompaniment pattern among the collective parallel parts. If the selected parallel parts have different pattern lengths or different beat numbers such as three-beat and four-beat, the reproduced automatic accompaniment is inconsistent in parallel progression of the multiple parts. Thus, the prior work (not prior art) suffers from the drawbacks that freedom of the part collection or combination is rather limited to obviate full use of the original accompaniment patterns. The same is true for composing a serial performance pattern of a given song from original performance pattern components having various beat numbers.

SUMMARY OF THE INVENTION

In view of the above noted drawbacks of the prior art, an object of the invention is to provide an accompaniment registration apparatus and an automatic accompaniment apparatus, realizing expanded, flexible and free arrangement of original accompaniment patterns. Another object of the invention is to realize a free combination of original accompaniment patterns while adjusting differences in pattern lengths and meters of the combined original accompaniment patterns.

According to the first aspect of the invention, an apparatus for composing an accompaniment pattern comprises memory means for memorizing a plurality of original accompaniment patterns corresponding to various accompaniment styles, each original accompaniment pattern being composed of a set of parallel parts, editor means for selecting different ones of the original accompaniment patterns and collecting therefrom a set of desired parts to compose a free accompaniment pattern which is different than the original accompaniment patterns, and production means for producing the free accompaniment pattern according to selected and collected results of the editor means. In this apparatus, the user can operate the editor means to input a prescription data effective to designate different original accompaniment patterns and to collect therefrom the new set of the desired parallel parts to register the free accompaniment pattern. After the registration, the memory means is accessed to read out the new parallel parts according to the prescription data to produce the free accompaniment pattern.

According to the second aspect of the invention, an automatic accompaniment apparatus comprises memory means for memorizing a plurality of original accompaniment part patterns having various pattern lengths, designating means for designating some of the original accompaniment part patterns to define a free accompaniment pattern which is a set of collective parallel part patterns, reading means for reading out the set of the collective parallel part patterns from the memory means concurrently with each other so as to produce the free accompaniment pattern, and control means operative during production of the free accompaniment pattern for controlling the reading means to regulate the reading of the collective parallel part patterns having the different pattern lengths, according to a pattern length of a particular one of the collective parallel part patterns to thereby maintain consistent progression of the collective parallel part patterns.

In a specific form of the second aspect, an automatic accompaniment apparatus comprises first memory means for memorizing a plurality of original accompaniment patterns corresponding to various accompaniment styles and having various pattern lengths, each accompaniment pattern being composed of a set of parallel parts having a common pattern length, second memory means for memorizing a prescription data effective to designate different ones of original accompaniment patterns and further effective to select therefrom a set of collective parallel parts having different pattern lengths to define a free accompaniment pattern, reading means operative according to the prescription data for reading out the set of the collective parallel parts from the first memory means concurrently with each other in response to a given tempo clock so as to reproduce the free accompaniment pattern, detecting means operative during reproduction of the free accompaniment pattern for detecting an end point of a particular one of the collective parallel parts, control means operative when the end point is detected for controlling the reading means to reset reading of the respective parallel parts concurrently with each other to each top point thereof to thereby repeat the reproduction of the free accompaniment pattern, and tone generating means for generating musical tones according to the reproduced free accompaniment pattern. In this apparatus, when the end point of the particular part is detected, all the parts concurrently return to the respective top point to continue the reading of the free accompaniment pattern. Consequently, the various pattern lengths of the remaining parts are compulsively adjusted to the particular part to effect the consistent reproduction of the free accompaniment pattern.

In another specific form of the second aspect, an automatic accompaniment apparatus comprises first memory means for memorizing a plurality of original accompaniment patterns corresponding to various accompaniment styles and having various pattern lengths, each accompaniment pattern being composed of a set of parallel parts having a common pattern length, second memory means for memorizing a prescription data effective to designate different ones of original accompaniment patterns and further effective to select therefrom a set of collective parallel parts having different pattern lengths to thereby define a free accompaniment pattern, reading means operative according to the prescription data for reading out the set of the collective parallel parts from the first memory means concurrently with each other in response to a given tempo clock so as to reproduce the free accompaniment pattern, detecting means operative during reproduction of the free accompaniment pattern for detecting each end point of respective shorter parallel parts which have a shorter pattern length than that of the longest parallel part, control means operative when each end point is detected for controlling the reading means to continue reading of a certain section of the respective shorter parallel part until the longest parallel part reaches an end point thereof to thereby complete concurrently all the collective parallel parts, and tone generating means for generating musical tones according to the reproduced free accompaniment pattern. In this apparatus, when the end point of each shorter part is detected, each shorter part returns to, for example, its top point to continue the reading, until the longest part reaches its end point. Consequently, the various pattern lengths of all the parallel parts are adjusted to the longest part, hence the entire pattern length of the longest part is fully utilized without mutilation.

According to the third aspect of the invention, an automatic accompaniment apparatus comprises memory means for memorizing a plurality of original accompaniment part patterns having various meters, designating means for designating some of the original accompaniment part patterns to define a free accompaniment pattern which is a set of collective parallel part patterns, producing means for reading out the set of the collective parallel part patterns from the memory means concurrently so as to produce the free accompaniment pattern, and control means operative during production of the free accompaniment pattern for controlling the producing means to modify a beat sequence of the respective parallel part patterns having different meters to thereby establish a meter consistency of the produced free accompaniment pattern.

In a specific form of the third aspect, an automatic accompaniment apparatus comprises memory means for memorizing a plurality of original accompaniment part patterns having various meters, designating means for designating some of the original accompaniment part patterns to define a free accompaniment pattern which is a set of collective parallel part patterns, detecting means for detecting a maximum meter among the set of the collective parallel parts so as to determine a standard beat number, producing means for reading out the set of the collective parallel part patterns from the memory means concurrently so as to produce the free accompaniment pattern, and control means operative during production of the free accompaniment pattern for controlling the producing means to add either a note or a rest into the respective parallel part patterns to supplement a deficient beat relative to the standard meter to thereby establish a meter consistency of the produced free accompaniment pattern. By such a construction, the beat sequence of each part pattern having less meter is compulsively adjusted to the standard meter so that all the parallel part patterns can be produced consistently with the standard meter. Accordingly, the original accompaniment part patterns having different meters can be freely combined regardless of the meter difference thereamong to thereby realize a wide variety of free automatic accompaniments while maintaining the musical consistency of tempo.

According to the fourth aspect of the invention, an apparatus for composing a performance pattern of a given song comprises memory means for memorizing a plurality of original performance patterns, editor means for serially selecting different original performance patterns to compose a free serial performance pattern of a given song, and for assigning a desired meter to the free serial performance pattern, detecting means for detecting a meter inconsistency between the assigned meter and the various meter of each selected original performance pattern, and reading means for serially reading out the selected original performance patterns while skipping or repeating a certain note within each measure according to the detected meter inconsistency to thereby edit the free serial performance pattern consistently with the assigned meter. By such a construction, when the editor means is operated to designate a desired meter different than that of each original performance pattern, the detecting means detects the inconsistency of the meter. The reading means skips or repeats reading of the original performance pattern according to the detected results to eliminate the meter inconsistency.

BRIEF DESCRIPTION OF THE DRAWINGS

FIG. 10 is a table diagram displaying one example of a song arrangement.

DETAILED DESCRIPTION OF EMBODIMENTS

Figure 1:
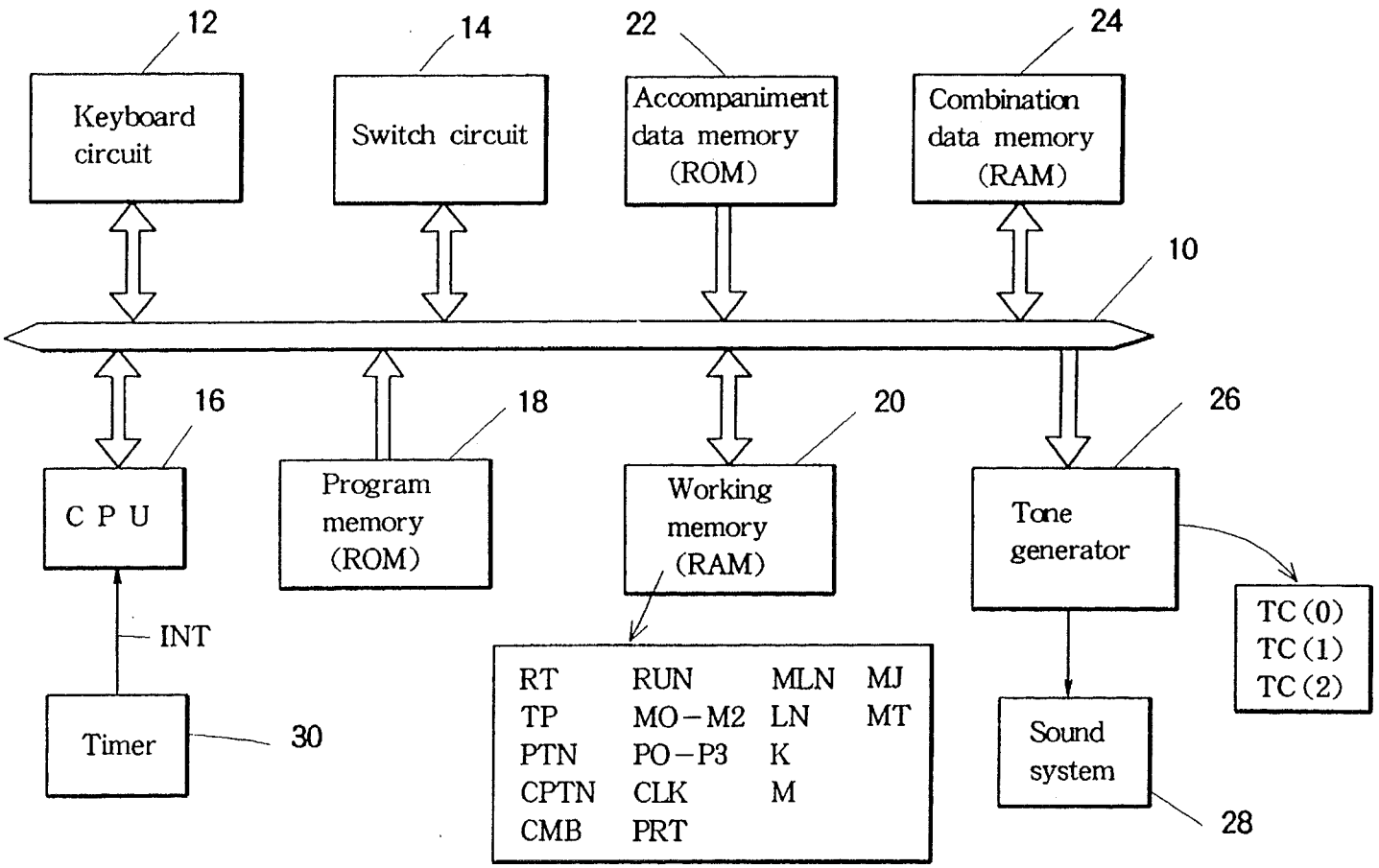
FIG. 1 is a block diagram showing a first embodiment of the inventive accompaniment apparatus installed in an electronic musical instrument.

FIG. 1 shows the first embodiment of the inventive automatic accompaniment apparatus in an electronic musical instrument. In this embodiment, a microcomputer is utilized to control either of manual performance and automatic accompaniment. A bus line 10 connects together a keyboard circuit 12, a switch circuit 14, a central processing unit (CPU) 16, a program memory 18, a working memory 20, an accompaniment data memory 22, a combination data memory 24, a tone generator 26 and so on.

The keyboard circuit 12 includes, for example, a single stage of a keyboard. The keyboard is normally divided into a right zone assigned for melody performance, and a left zone assigned for chord accompaniment. The keyboard is provided with key switches which are scanned to detect key touch information.

The switch circuit 14 includes various manual switches arranged on a panel. There are provided six switches used in connection with the present invention, as follows:

(1) A start/stop switch operable to command start and stop of an automatic accompaniment.

(2) An accompaniment pattern select switch operable to select a desired one of plural accompaniment patterns which are prepared for each of different accompaniment styles such as Rock'n'Roll, Waltz and so on. This switch is operated when initiating the automatic accompaniment, or when arranging a prescription or combination data.

(3) A combination pattern select switch for use in selecting a desired one of plural registered combination patterns. This switch is also operated when starting the automatic accompaniment, or when arranging the combination data.

(4) A combination processing switch which is turned on when a combination process or an arrangement process is initiated to arrange the combination data, and which is turned off when the combination process is finished.

(5) A part select switch used for selecting one of four parts, i.e., Chord I, Chord II, Bass and Drum. The Chord I and Chord II are parts mainly for automatic chord accompaniment in a middle tone pitch range. The Bass part is provided for automatic bass accompaniment in a lower tone pitch range. The Drum part is provided for automatic rhythm accompaniment containing percussion sound such as a drum and cymbal.

(6) A registration switch which is actuated to register accompaniment patterns selected for arranging the combination data. In the switch circuit, the various switches are scanned to detect input information for each switch.

The CPU 16 executes various processings according to an operation program stored in the program memory 18 composed of a read-only memory (ROM) for generating sounds of the manual performance and the automatic accompaniment. These processings will be described later in conjunction with FIGS. 4–8.

The working memory 20 is composed of a random access memory (RAM) which provides memory areas for use as registers and counters in the various processings by the CPU 16. Detailed description will be given later to particular registers adopted in the present invention.

Figure 2:
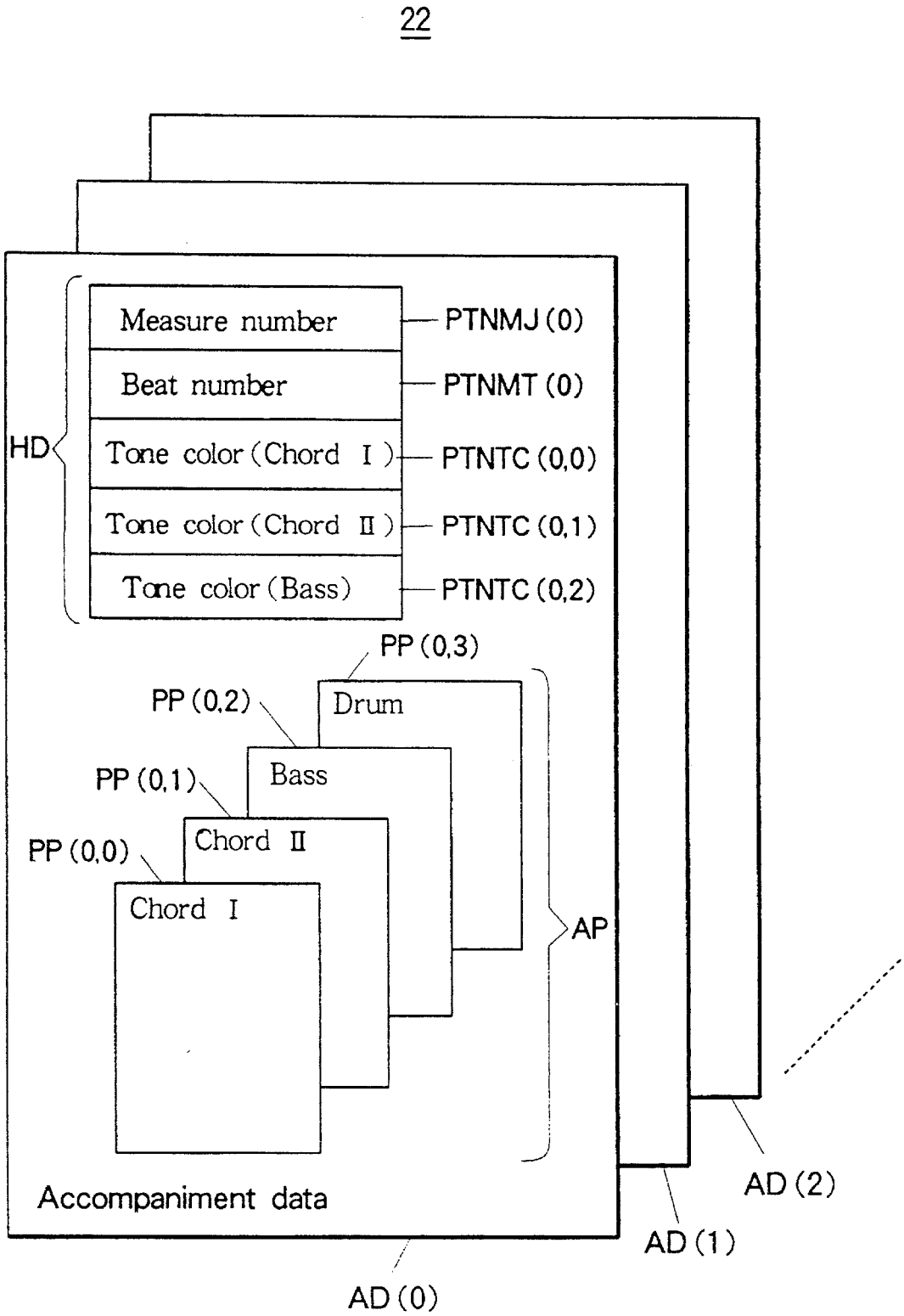
FIG. 2 is a diagram showing a memory format of an original accompaniment data.

The accompaniment data memory 22 is composed of a ROM having a data format, for example, as shown in FIG. 2. The memory 22 stores a plurality of original accompaniment data An(0), An(1), An(2)—corresponding to different accompaniment styles such as Rock'n'Roll, Waltz and so on. As indicated typically by AD(0), each accompaniment data is composed of a header data HD and a preset accompaniment pattern data AP. For example, with regard to the accompaniment data AD(0), the header data HD includes a measure number data PTNMJ(0), a beat number data PTNMT(0), tone color data PTNTC(0,0), PTNTC(0,1) and PTNTC(0,2) of the Chord I, Chord II and Bass parts, respectively. The accompaniment pattern data AP includes respective part pattern data PP(0,0), PP(0,1), PP(0,2) and P(0,3) of Chord I, Chord II, Bass and Drum. Each part pattern data PP represents an accompaniment tone sequence within a given number of measures. Thus, the accompaniment pattern represented by one accompaniment data AD is comprised of the four different accompaniment tone sequences represented by the different part pattern data of the four parallel parts. There are a plurality of accompaniment patterns numbered 0, 1, 2, . . . corresponding to the zero-th, first, second, . . . accompaniment data. Hereinafter, the accompaniment tone sequence represented by the part pattern data is called "part pattern". Each part pattern is designated by PP(X,Y) where X denotes an accompaniment pattern number, and Y denotes a part number. Further, the notation of the accompaniment pattern number by the reference X and the notation of the part number by the reference Y are applied to the part pattern tone color data, exemplified by PTNTC(X,Y). The pattern measure number data PTNMJ denotes a number (for example, 2) of the measures involved in the part pattern. The pattern beat number PTNMT denotes a number of beats within one measure. In this embodiment, one beat corresponds to a quarter note so that the PTNMT denotes a number of quarter notes within one measure. For example, if the zero-th accompaniment data AD(0) is arranged by ¾ meter, the beat number data PTNMT(0) takes a value "3". In manner similar to the zero-th accompaniment data AD(0), the header data and the part pattern data are written into the memory 22 for the first accompaniment data AD(1), the second accompaniment data AD(2), . . . . The respective accompaniment data AD(0), AD(1), AD(2), . . . have various pattern lengths which are determined in terms of the measure number and the beat number. For example, the accompaniment data AD(1) and AD(2) have the same beat number "3", but have different measure numbers "2" and "4", respectively. On the other hand, the accompaniment data AD(3) and AD(4) have the same measure number "2", but have different beat numbers "3" and "4", respectively.

Figure 3:
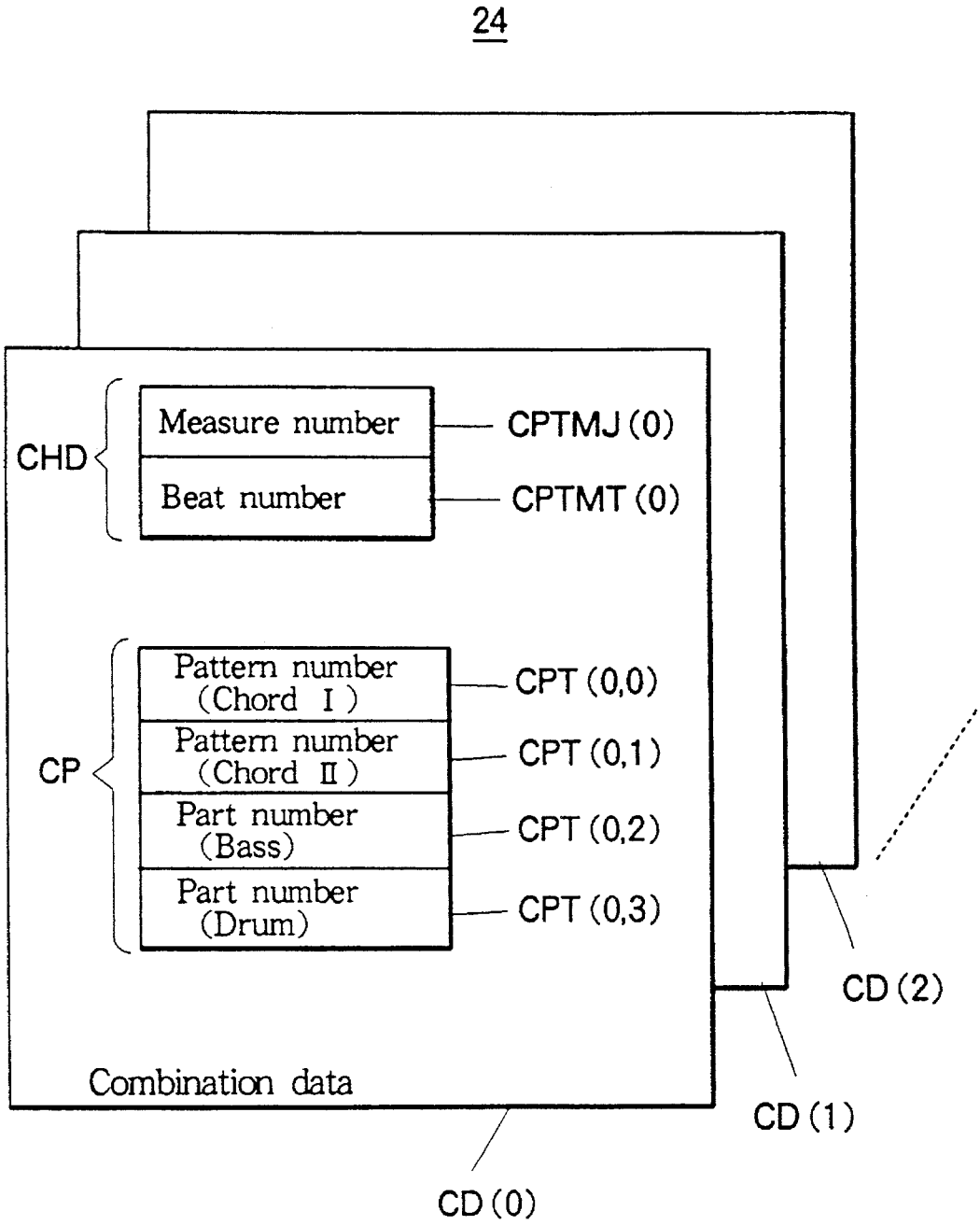
FIG. 3 is a diagram showing a memory format of a prescription or combination data.

Referring next to FIG. 3, the combination data memory 24 is composed of a RAM into which a user can write different prescription data or combination data CD(0), CD(1), CD(2), . . . in a given format. As exemplified by the zero-th CD(0), the combination data CD is comprised of a header data CHD and a combination pattern data CP. For example, with regard to the zero-th combination data CD(0), the header data CHD contains a measure number data CPTMJ(0) and a beat number data CPTMT(0). In turn, the combination pattern data CP contains a set of part pattern number data CPT(0,0), CPT(0,1), CPT(0,2) and CPT (0,3), corresponding to the respective parts of Chord I, Chord II, Bass and Drum. Each part pattern number data CPT designates a part pattern which is used in a free or combination accompaniment, and which is selected from one original accompaniment data. The selected part pattern is identified by the original accompaniment pattern number. For example, the part pattern number data CPT(0,0) may designate the accompaniment pattern number "0", which means that the part pattern PP(0,0) of FIG. 2 is selected as the Chord I part of the zero-th combination accompaniment pattern of FIG. 3. Each combination accompaniment pattern represented by CP is comprised of the four part patterns designated by the set of four part pattern numbers CPT. Each combination accompaniment pattern is identified by its order number 0, 1, 2, . . . such as the zero-th combination data CD(0), the first combination data CD(1), the second combination data CD(2), . . . . In manner similar to the zero-th combination data CD(0), a set of the header data CHD and the combination pattern data CP is registered into the memory 24 for the first combination data CD(1), the second combination data CD(2), . . . .

Hereinafter, each part pattern number data is generally represented by a notation CPT(P,Q) where P denotes a combination pattern number, and Q denotes a part number thereof. Further, the notation CPT(P,Q) is used also for denoting a memory location in which the data represented by CPT(P,Q) is stored. For example, CPT(0,0) denotes both the part pattern number and its memory location. When the user arranges a combination pattern data, a desired original accompaniment pattern number is selected and designated for each of the four parts. For example, the original accompaniment pattern number "0" is selected for the Chord I part, the original accompaniment pattern number "1" is selected for the Chord II part, the original accompaniment pattern number "3" is selected for the Bass part, and the original accompaniment pattern number "5" is selected for the Drum part. Namely, the respective parts of the combination accompaniment pattern can be freely selected from different original accompaniment patterns of different styles so as to compose the combination accompaniment pattern in mosaic or collective manner.

As described before in conjunction with FIG. 2, the respective accompaniment data AD(0), AD(1), AD(2) . . . have different pattern lengths. Four part patterns having different pattern lengths are freely combined together to compose one combination pattern. However, if the combination pattern is simply read out repeatedly to effect an automatic accompaniment, end timings would be different among the four collective parallel parts, which would cause inconsistency during the course of the repeated automatic accompaniment by the combination data. In order to avoid such an inconsistency of the automatic accompaniment, according to the invention, the pattern lengths of the respective parts are dynamically adjusted to the same pattern length during the course of the reproduction of the automatic accompaniment. Practically, for example, a particular part pattern having the longest pattern length is detected or discriminated among the four collective parallel parts. The measure number and the beat number of the longest part are memorized as the measure number data CPTMJ and the beat number data CPTMT, respectively, as shown in FIG. 3. The effective pattern length of the combination accompaniment pattern is adjusted consistently according to these memorized data CPTMJ and CPTMT.

Referring back to FIG. 1, the tone generator 26 includes a first tone generating unit for the manual performance and a second tone generating unit for the automatic accompaniment. The second tone generating unit contains four tone generating channels corresponding to the four parallel parts of the Chord I, Chord II, Bass and Drum. Three of the tone generating channels corresponding to the Chord I, Chord II and Bass parts are provided with tone color registers TC(0), TC(1) and TC(2), respectively. Each tone generating channel can generate a musical tone signal having a timbre determined by a tone color data loaded into the tone color register. A sound system 28 is connected to the tone generator 26 to convert the musical tone signals fed from the respective channels into a composite musical sound of the manual performance and the automatic accompaniment. In addition, a timer 30 is provided for feeding an interruption command signal INT to the CPU 16. The interruption command signal INT is generated at every timing corresponding to a 1/96 note through one measure. The CPU 16 operates everywhen the interruption command signal INT is transmitted for conducting an interruption process shown in FIG. 7.

The working memory 20 is provided with 15 kinds of registers or others in association with the inventive operation. These registers are used in various processings shown in FIGS. 4–8. The involved registers are graphically illustrated by FIG. 1 in connection with the block of the working memory 20, and are listed below.

(1) A chord root note register RT, which stores a chord root note data (for example, a data representative of a root note name C) obtained by a chord detection process.

(2) A chord type register TP, which stores a chord type data (for example, a data representative of a chord type Major) obtained by the chord detection process.

(3) An accompaniment pattern number register PTN, which is set with an original accompaniment pattern number selected by the accompaniment pattern select switch.

(4) A combination pattern number register CPTN, which is set with a free combination pattern number selected by the combination pattern select switch.

(5) A combination flag CMB, which is a one-bit register settable with either of "1" indicative of an automatic accompaniment mode by the free combination pattern, and "0" indicative of another automatic accompaniment mode by the original or regular accompaniment pattern.

(6) A run flag RUN, which is a one-bit register settable with either of "1" indicative of a running state of the automatic accompaniment, and "0" indicative of a suspended state of the automatic accompaniment.

(7) Accompaniment pattern number registers M0, M1 and M2, which are provided correspondingly to the respective parts of Chord I, Chord II and Bass for storing selected accompaniment pattern numbers.

(8) Address pointers P0–P3, which are provided to indicate reading addresses for the respective part patterns of the Chord I, Chord II, Bass and Drum.

(9) A clock counter CLK, which counts the interruption command signal INT fed from the timer 30, as a tempo clock signal. The clock counter CLK is reset to "0" at the concurrent end of the respective part patterns during the regular automatic accompaniment. Otherwise, the clock counter CLK is reset to "0" at an end point of a particular part pattern having the longest pattern length in the combination accompaniment pattern during the automatic accompaniment.

(10) A part number register PRT, which is set with a given part number.

(11) Pattern length comparing registers MLN and LN, which are used for comparing pattern lengths of different part patterns. The pattern length is determined by a product of the measure number and the beat number.

(12) A variable register K, which is set with a variable K =0–4 during the combination process.

(13) A part pattern number register M, which is set with a part pattern number read from the combination data memory 24.

(14) A measure number register MJ, which is set with a measure number data.

(15) A meter register MT, which is set with a meter in terms of a beat number.

Figure 4:
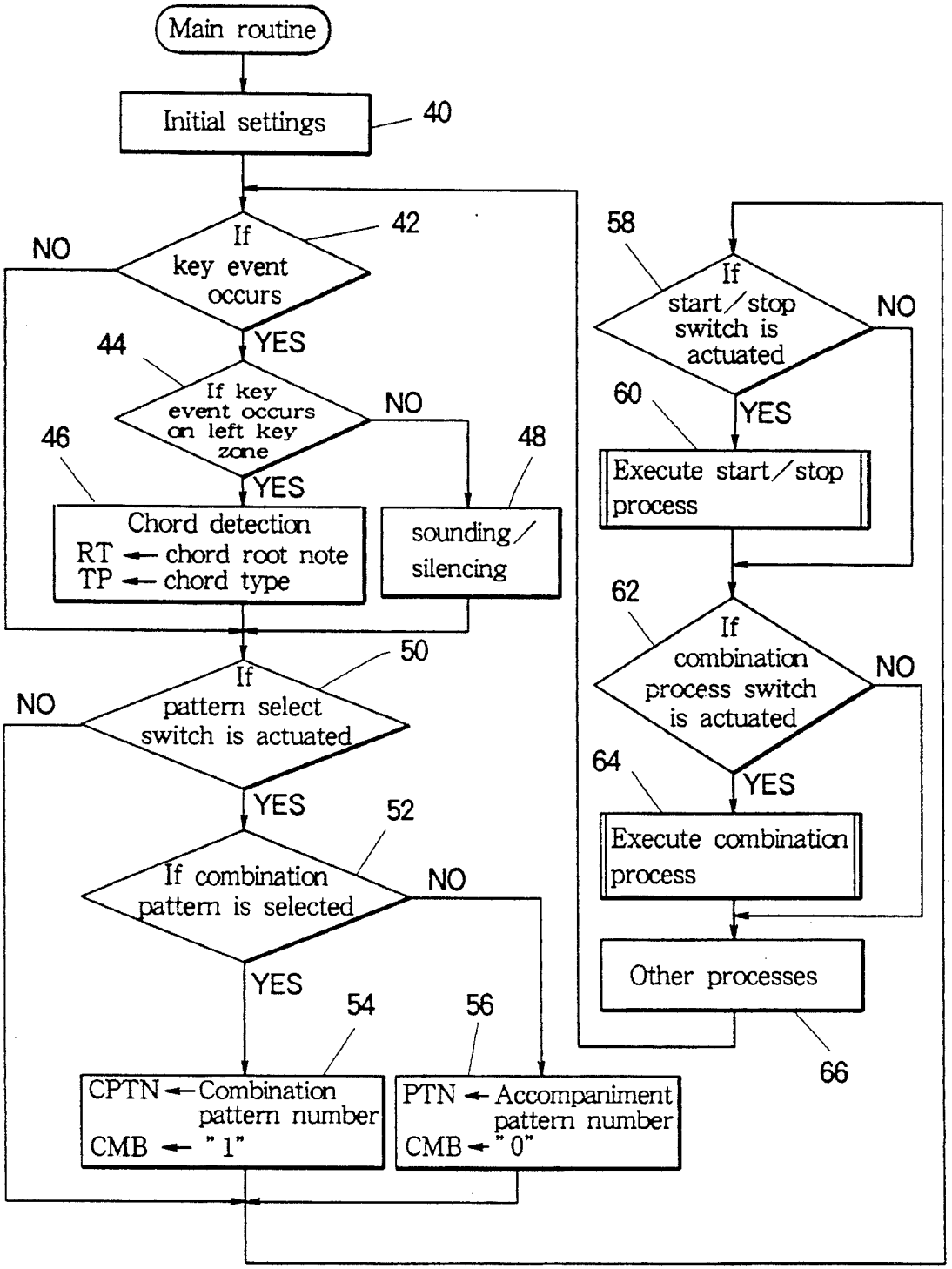
FIG. 4 is a flowchart showing a main routine executed in the first embodiment.

FIG. 4 shows a process flow of a main routine which is commenced in response to power-on of the FIG. 1 system. At first, Step 40 is carried out to effect an initial setting process such that the various registers are reset to an initial state, thereby proceeding to Step 42. In Step 42, check is made as to if a key event of key-on and key-off occars on the keyboard of the keyboard circuit 12. If the key event occars (Y), Step 44 is undertaken to check as to if the key event occurs in the left zone of the keyboard. If the check result is affirmative (Y), Step 46 is undertaken to carry out the chord detection process. Namely, a chord root note and a chord type are detected according to key actuations on the left key zone, and the detected results are set into the root note register RT and the chord type register TP, respectively. In turn, if the check result of Step 44 is negative (N), it is found that the key event is taken place in the right key zone, thereby proceeding to Step 48 to carry out a sounding/silencing process. Namely, if the key event indicates the key-on action, a tone pitch data designated by an on-key is fed to the manual tone generating unit of the tone generator 26 to generate a musical tone signal so as to sound the manual performance. Otherwise, if the key event indicates the key-off action, attenuation of the tone signal designated by an off-key is commenced so as to silence the same.

On the other hand, if the check result of Step 42 is negative (N), or after either of Steps 46 and 48 is finished, subsequent Step 50 is undertaken to check as to if either of the accompaniment pattern select switch and the combination pattern select switch is actuated. If this check result is affirmative (Y), subsequent Step 52 is undertaken to check as to if a combination pattern is selected. If this check result is affirmative (Y), Step 54 is undertaken to set the selected combination pattern number into the register CPTN as well as to set "1" into the flag CMB. In turn, if the check result of Step S52 is negative (N), it is found that an accompaniment pattern is selected. Thus, Step S56 is undertaken to set the selected accompaniment pattern number into the register PTN as well as to set the value "0" into the flag CMB.

Next, Step S58 is undertaken if the check result of Step 50 is negative (N) or after either of Steps S54 and S56 is finished. In Step S58, check is made as to if the start/stop switch is actuated. If this check result is affirmative (Y), Step 60 is undertaken to execute a subroutine of start/stop process. Next, Step 62 is undertaken if the check result of Step 58 is negative (N) or after Step 60 is finished. In Step 62, check is made as to if the combination process switch is actuated. If this check result is affirmative (Y), Step 64 is undertaken to execute a subroutine of the combination process or arrangement process which will be described later in conjunction with FIG. 6. Lastly, Step 66 is undertaken if the check result of Step 62 is negative (N) or after Step 64 is finished. Other processes are executed in Step 66, thereafter returning to Step 42 to repeatedly carry out the above described main routine.

Figure 5:
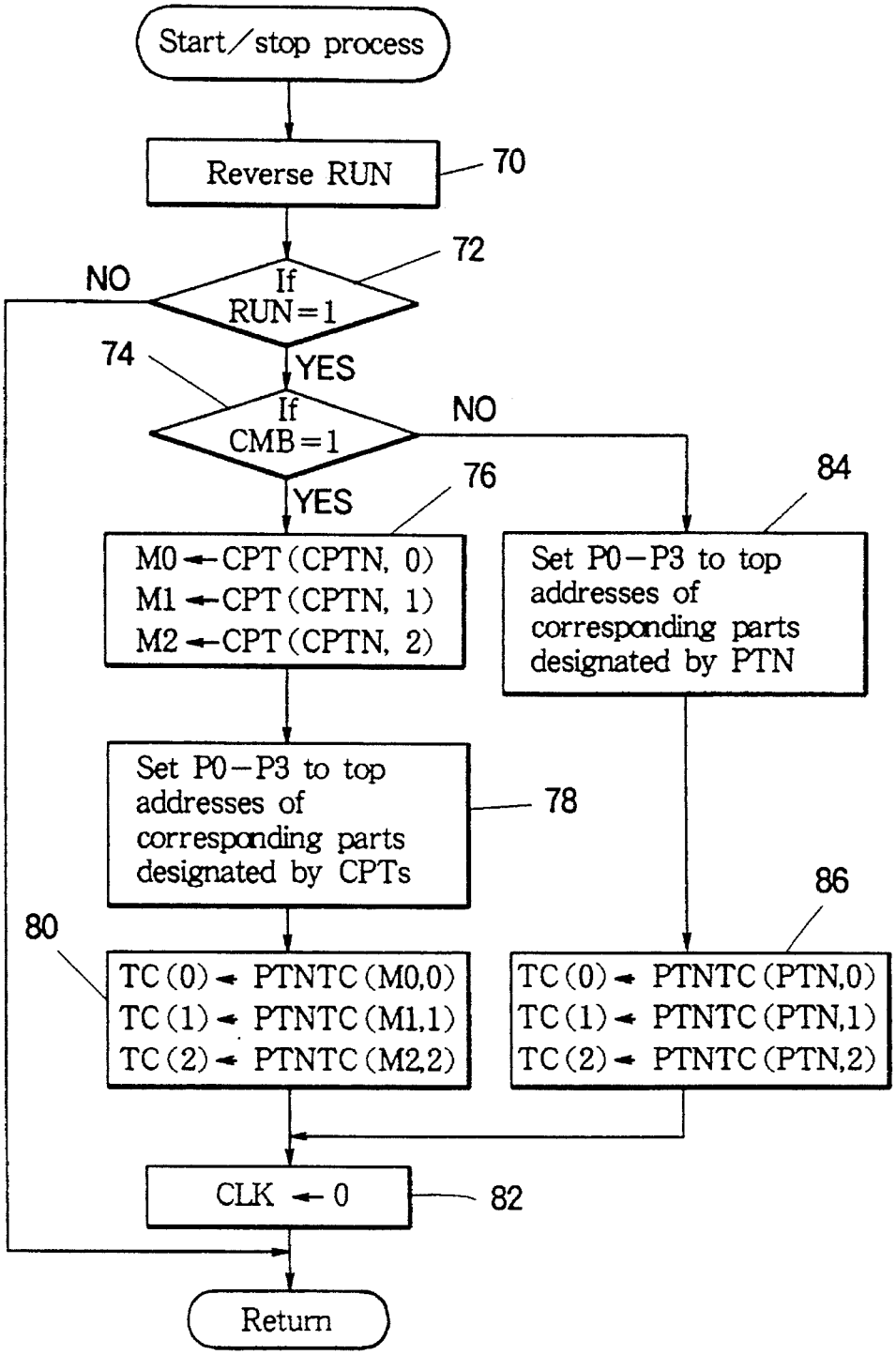
FIG. 5 is a flowchart showing a subroutine of a start/stop process.

FIG. 5 shows the subroutine of the start/stop process. Firstly in Step 70, the run flag RUN is reversed from "1" to "0" or vice versa in response to the actuation of the start/stop switch. Then, subsequent check is made in Step 72 as to if RUN="1". If this check result is negative (N), the processing returns to the main routine of FIG. 4 since there is no need to commence the automatic accompaniment. On the other hand, if the check result of Step 72 is affirmative (Y), Step 74 is undertaken to check as to if the flag CMB is set with the value "1", i.e., as to if the automatic accompaniment is effected by the combination pattern. If this check result is affirmative (Y), Step 76 is undertaken to retrieve from the memory 24 three of the pattern number data CPT(CPTN,0), CPT(CPTN,1) and CPT(CPTN,2) of the Chord I, Chord II and Bass parts contained in the selected combination pattern designated by the content of the register CPTN. Then, the retrieved pattern number data CPT(CPTN,0), CPT(CPTN,1) and CPT(CPTN,2) are written or latched into the registers M0, M1 and M2, respectively. For example, in case that the register CPTN indicates the combination pattern number "1", the pattern number data CPT(1,0), CPT(1,1) and CPT(1,2) of the first combination data CD(1) are retrieved from the memory 24, and are written into the registers M0, M1 and M2, respectively.

Next in Step 78, pointers P0–P3 corresponding to the four combination parts are set to a top address of each of the four part patterns which are designated by the pattern number data CPTs contained in the combination data selected by the content of the register CPTN. For example, in case that the content of the register CPTN indicates "1" and provided that the respective pattern number data CPT(1,0), CPT(1,1), CPT(1,2)and CPT(1,3)indicate original accompaniment pattern numbers "2", "1", "0" and "0", respectively, the pointers P0, P1, P2 and P3 are set to each top address of the Chord I part pattern PP(2,0) contained in the second accompaniment data AD(2) (FIG. 2), the Chord II part pattern PP(1,1) contained in the first accompaniment data AD(1), the Bass part pattern PP(0,2) contained in the zero-th accompaniment data AD(0), and the Drum part pattern PP(0,3) contained in the zero-th accompaniment data AD(0).

Then, in Step 80, the memory 22 is accessed to read out therefrom the tone color data PTNTC(M0,0), PTNTC(M1,1) and PTNTC(M2,2) of the respective Chord I, Chord II and Bass parts which are designated by the pattern numbers CPTs latched in the registers M0, M1 and M2, respectively. Then, the retrieved tone color data PTNTC(M0,0), PTNTC(M1,1) and PTNTC(M2,2) are written into the registers TC(0), TC(1) and TC(2), respectively. For example, in case that the registers M0, M1 and M2 indicate the original accompaniment pattern numbers "2", "1" and "0", respectively, as described above, the memory 22 is accessed to read out the Chord I tone color data PTNTC(2,0) contained in the second accompaniment data AD(2), the Chord II tone color data PTNTC(1,1) contained in the first accompaniment data AD(1) and the Bass tone color data PTNTC(0,2) contained in the zero-th accompaniment data AD(0), all of which are written into the registers TC(0), TC(1) and TC(2), respectively.

On the other hand, if the check result of Step 74 is negative (N), it is found that the automatic accompaniment is carried out according to the regular accompaniment pattern, thereby advancing to Step 84. In this step, the pointers P0–P3 are set to each of top addresses of the four part patterns contained in the accompaniment pattern designated by the content of the register PTN. For example, in case that the content of the register PTN indicates an accompaniment pattern number "1" in the FIG. 2 data format, the pointers P0, P1, P2 and P3 are set to top addresses of the part patterns PP(1,0), PP(1,1), PP(1,2) and PP(1,3), respectively, of the first accompaniment data AD(1). In subsequent Step 86, the memory 22 is accessed to read out tone color data PTNTC(PTN,0), PTNTC(PTN,1) and PTNTC(PTN,2) of the Chord I, Chord II and Bass parts, respectively, which are designated by the accompaniment pattern number latched in the register PTN. The retrieved tone color data PTNTC(PTN,0), PTNTC(PTN,1) and PTNTC(PTN,2) are written into the registers TC(0), TC(1) and TC(2), respectively. Lastly, Step 82 is undertaken after either of Steps 80 and 86 is finished for resetting the counter CLK to "0", thereafter returning to the main routine of FIG. 4.

Figure 6:
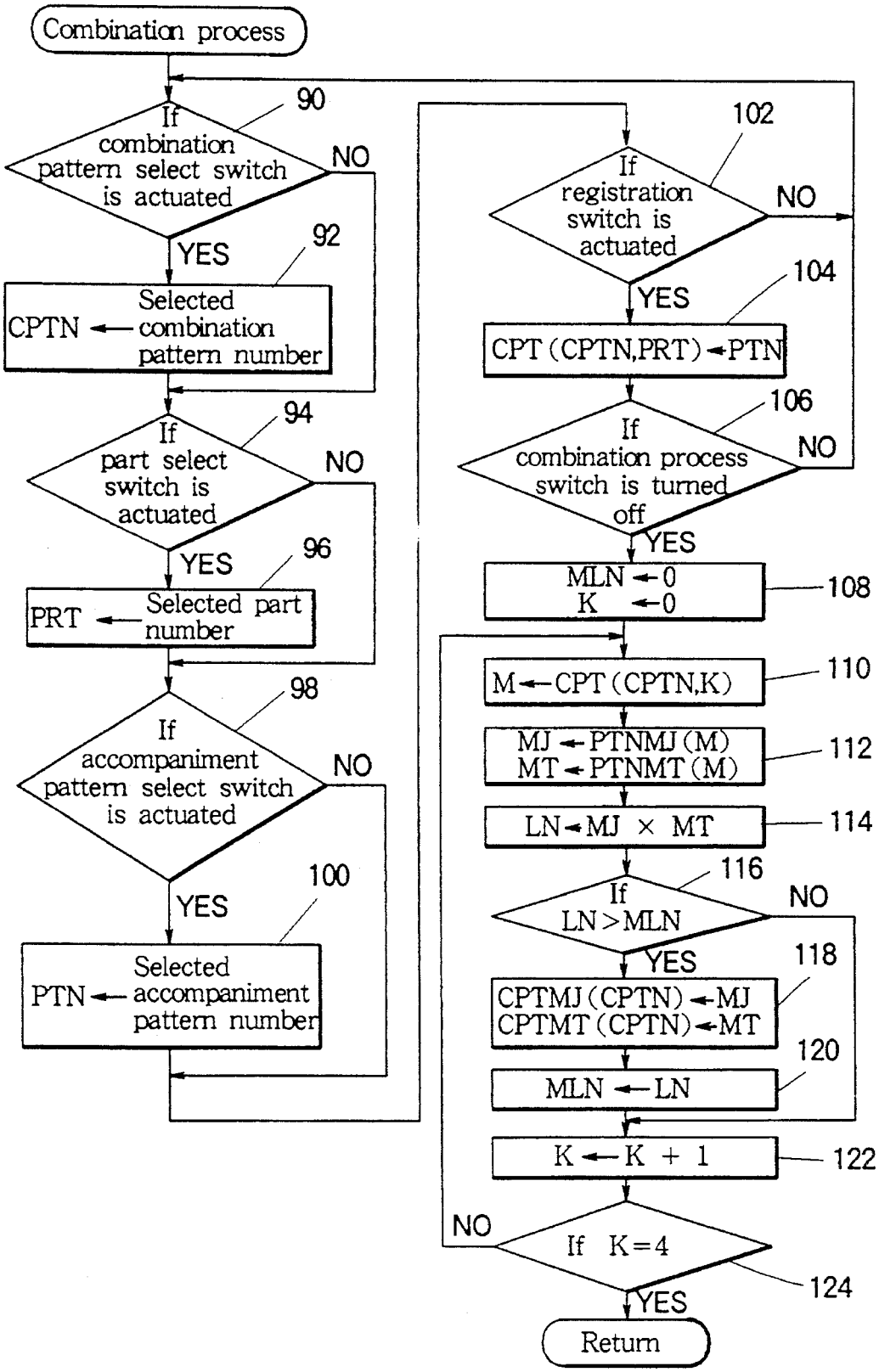
FIG. 6 is a flowchart showing a subroutine of a combination process.

FIG. 6 shows the subroutine of the combination process or arrangement process. Firstly, Step 90 is undertaken to check as to if the combination pattern select switch is turned on. If this check result is affirmative (Y), Step 92 is undertaken to set the selected combination pattern number into the register CPTN. On the other hand, if the check result of Step 90 is negative (N) or after Step 92 is finished, Step 94 is undertaken to check as to if the part select switch is turned on. If this check result is affirmative (Y), Step 96 is undertaken to set the selected part number into the register PRT. If the check result of Step 94 is negative (N) or after Step 96 is finished, Step 98 is undertaken to check as to if the accompaniment pattern select switch is turned on. If this check result is affirmative, Step 100 is undertaken to set the selected accompaniment pattern number into the register PTN. If the check result of Step 98 is negative (N) or after Step 100 is finished, Step 102 is undertaken to check as to if the registration switch is turned on. If this check result is negative (N), the processing returns to Step 90 to thereby repeat the aforementioned operation. Consequently, the user can select and set desired ones of the combination pattern number, the part number and the accompaniment pattern number into the registers CPTN, PRT and PTN, respectively.

After such a setting process, the registration switch is turned on so that the check result of Step 102 is turned affirmative (Y), thereby proceeding to Step 104. In this step, the accompaniment pattern number stored in the register PTN is written into the pattern number data memory location CPT(CPTN,PRT) of the memory 24, which is designated by those of the combination pattern number stored in the register CPTN and the part number stored in the register PRT. For example, in case that the registers CPTN, PRT and PTN are set with values "0", "0" and "1", respectively, the accompaniment pattern number "1" is written into the memory location CPT(0,0) shown in FIG. 3. This accompaniment pattern number "1" written in CPT(0,0) specifies the Chord I part pattern PP(1,0) of the accompaniment data AD(1) as the Chord I part pattern of the combination data CD(0).

Next, Step 106 is undertaken to check as to if the combination process switch is turned off. If this check result is held negative (N), the processing returns to Step 90 to thereby repeat the above described operation. Accordingly, after the user once registers the accompaniment pattern number PTN into the memory location CPT(CPTN,PRT) as described above, the user repeatedly selects another desired set of a part and an accompaniment pattern, and turns the registration switch on to thereby register the accompaniment pattern numbers for the three of the remaining parts. For example, after the accompaniment pattern number "1" is registered into the memory location CPT(0,0), then the different accompaniment pattern numbers "0", "2" and "4" are sequentially selected correspondingly to the part numbers "1", "2" and "3", and the registration switch is turned on whenever the accompaniment pattern number is selected. Consequently, the selected accompaniment pattern numbers "0", "2" and "4" are registered into the memory locations CPT(0,1), CPT(0,2)and CPT(0,3), respectively.

After the desired combination pattern is composed as described above, the combination process switch is turned off so that the check result of Step 106 is switched affirmative (Y), thereby proceeding to Step 108. In this step, the registers MLN and K are set with "0", respectively. In subsequent Step 110, the memory 24 is accessed to read out the pattern number data CPT(CPTN,K) designated by the combination pattern number CPTN and the variable K, which is then latched into the register M. In case that the combination pattern number CPTN indicates "0" as exemplified above, the register M is initially set with the pattern number data CPT(0,0). Next, in Step 112, the memory 22 is accessed to read out a measure number data PTNMJ(M) and a beat number data PTNMT(M) contained in the accompaniment data designated by the content of the register M, and the retrieved PTNMJ(M) and PTNMT(M) are written into the registers MJ and MT, respectively. Then, Step 114 is undertaken to calculate a product of the measure number held in the register MJ and the beat number held in the register MT. The product representative of the pattern length is set in the register LN. In subsequent Step 116, check is made as to if the value of the register LN is greater than that of the register MLN. When Step 116 is undertaken first time after the register MLN is set to "0" in Step 108, this check result is affirmative (Y) to thereby proceed to Step 118. In this step, the measure number data of the register MJ and the beat number data of the register MT are written, respectively, into the measure number data memory location CPTMJ(CPTN) and the beat number data memory location CPTMT(CPTN) of the memory 24, which are designated by the combination pattern number stored in the register CPTN. In the aforementioned example, the combination pattern number stored in the register CPTN indicates "0", so that the contents of the registers MJ and MT are written into the memory locations CPTMJ(0) and CPTMT(0), respectively, as shown in FIG. 3. Thereafter, Step 120 is undertaken to transfer the pattern length data from the register LN to the register MLN.

Figure 7:
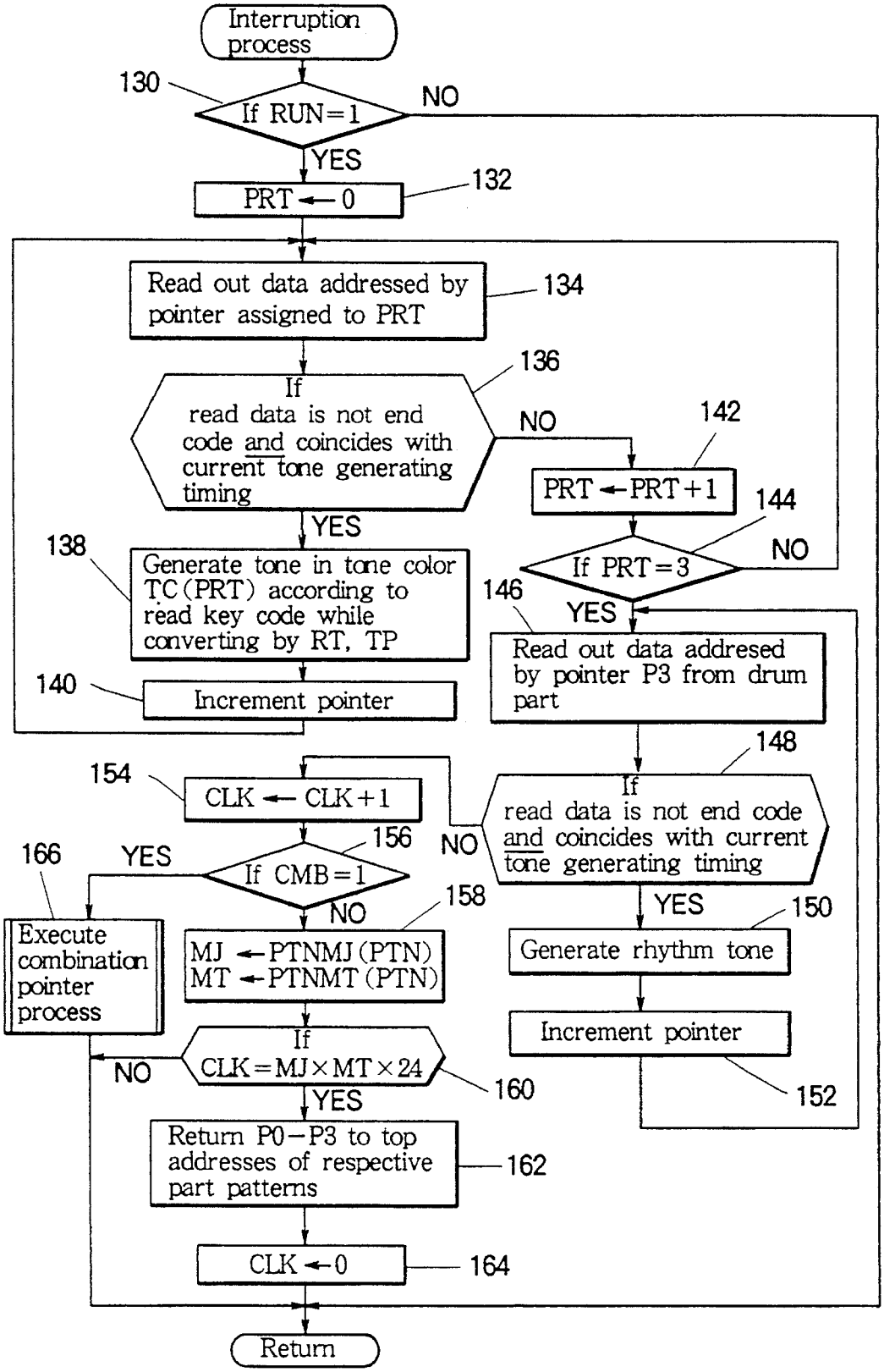
FIG. 7 is a flowchart showing an interruption process.

After Step 120 is finished or if the check result of Step 116 is negative, Step 122 is undertaken to increment the register K by "1". Further, Step 124 is undertaken to check as to if the value of the register K reaches "4". When Step 124 is undertaken first time after Step 108, the value of the register K is updated to "1" so that the check result of Step 124 is negative (N), thereby returning to Step 110. Then, the above described routine is repeatedly carried out until the value of the register K reaches "4". For example, when the combination pattern number "0" is indicated by the register CPTN, the pattern number data stored in the memory location CPT(0,1) is written into the register M in Step 110. Then, in Step 112, the measure number and the beat number contained in the accompaniment data designated by the value of the register M are loaded into the registers MJ and MT. In Step 114, the values of the registers MJ and MT are multiplied with each other to calculate the pattern length, which is loaded into the register LN. Thereafter, check is made in Step 116 as to if the pattern length loaded in the register LN is longer than that stored in the register MLN. If this check result is negative (N), the processing jumps to Step 122 while skipping Steps 118, 120. Accordingly, those of the CPTMJ(0), CPTMT(0) and MLN are not updated so that the previous pattern length data can be held as it is. Thereafter, the above described routine is repeatedly executed until the value of the register K reaches "4", so that the register MLN is set with the longest pattern length among the four part patterns designated by the pattern number data CPT(0,0)–CPT(0,3). Further, the memory locations CPTMJ(0) and CPTMT(0) are written with the measure number and the beat number of the longest part pattern. Either of the written measure number and the beat number may be maximum. When the value of the register K reaches "4", the Check result of Step 124 turns affirmative (Y), thereby returning to the main routine of FIG. 4. By such a manner, the combination data CD(0) is arranged with regard to the combination pattern number "0". Thereafter, the above described combination process is conducted to form the combination data CD(1), CD(2), . . . for further combination pattern numbers "1", "2", FIG. 7 shows a routine of the interruption process. This routine is called everywhen the timer 30 of FIG. 1 generates the interruption command signal INT. Firstly, Step 130 is undertaken to check as to if the run flag RUN is set with "1". If this check result is negative (N), the processing immediately returns to the main routine of FIG. 4 since the following automatic accompaniment tone generating is not needed. In turn, if the check result of Step 130 is affirmative, Step 132 is undertaken to set the register PRT to "0". Then, Step 134 is undertaken to access the memory 22 according to a pointer assigned to the part designated by the part number held in the register PRT to thereby read out an addressed data from the designated part pattern. When Step 134 is executed the first time after Step 132 is carried out, one timing data is read out from the Chord I part pattern designated by the part number "0". Next, Step 136 is undertaken to check as to if the read timing data is not an end code data and the read timing data indicates an instant tone generating timing. In this step, a prescribed tone generating timing of the read timing data is compared to a current timing indicated by the count value of the counter CLK. If both the timings coincide with each other, it is judged that the timing data indicates the instant tone generating timing. If the check result of Step 136 is affirmative, subsequent Step 138 is undertaken to carry out the musical tone generating process. In this process, a key code (tone pitch data) read out from the memory 22 is converted suitably according to those of the chord root note data stored in the register RT and the chord type data stored in the register TP so as to determine an actual tone pitch. Then, the determined tone pitch data is fed to a musical tone generating channel which has the tone color register TC(PRT) corresponding to the part number set in the register PRT. For example, when the processing proceeds to Step 138 the first time from Step 132, the tone generating channel of Chord I having the register TC(0) generates a musical tone signal having a timbre specified by the tone color data set in the register TC(0) and having a specified pitch. Then, Step 140 is undertaken to increment the pointer, thereby returning to Step 134. Again, Step 134 is undertaken in a manner similar to the previous time for reading out a next timing data of the same part pattern. Subsequently, the check is made in Step 136 in similar manner as the previous time. If this check result is affirmative (Y), Step 138 is undertaken to generate a musical tone signal. Then, the processing returns to Step 134 via Step 140. By such a manner, two or more tone signals can be generated concurrently at one timing indicated by the counter CLK to sound a chord.

If the check result of Step 136 is negative (N), Step 142 is undertaken to update the value of the register PRT by one. For example, when the processing proceeds to Step 142 for the first time after Step 132 is carried out, the value of PRT is updated to "1". Then, Step 144 is undertaken to check as to if the value of PRT reaches "3". If this check result is negative (N), the processing returns to Step 134. For example, when the value of PRT indicates "1", the above described operation is carried out through Steps 134–140 in a similar manner to generate one or more tone signal of Chord II having the part number "1". Then, Step 142 is undertaken after Step 136 to update the value of PRT to "2", so that one or more tone signals of Bass part designated by the part number "2" is generated. Finally, Step 142 is again undertaken after Step 136 to update the value of PRT to "3". Consequently, the check result of Step 144 turns affirmative (Y) to thereby proceed to Step 146.

In Step 146, the memory 22 is accessed by the pointer P3 to read out one timing data of the Drum part pattern. Then, Step 148 is undertaken in manner similar to Step 136 for checking as to if the read timing data is not an end code data and the read timing data coincides with an instant or current tone generation timing. If this check result is affirmative (Y), Step 150 is undertaken to execute a rhythm tone generating process. In this rhythm tone generating process, one or more percussion tone signals are generated by the Drum part tone generating channel according to percussion kind data of the Drum part pattern. After Step 150, the pointer P3 is incremented in Step 152, thereby returning to Step 146. In Step 146, another timing data of the Drum part is read out in manner similar to the previous time. Then, Step 148 is again undertaken to carry out the check. If this check result is negative (N), the processing proceeds to Step 154.

In Step 154, the value of the counter CLK is incremented by one. Then, Step 156 is undertaken to check as to if the flag CMB is set with "1". If this check result is negative (N), Step 158 is undertaken to access the memory 22 to read out the measure number data PTNM J(PTN) and the beat number data PTNMT(PTN) of the selected accompaniment data identified by the value of the register PTN. These read data PTNMJ and PTNMT are written into the registers MJ and MT. Next, Step 160 is undertaken to check as to if the value of the counter CLK reaches the product value of the measure number latched in the register MJ, the beat number latched in the register MT and the clock number "24" per one beat, the product value being indicative of the end of the accompaniment pattern. If this check result is negative (N), the processing returns to the main routine of FIG. 4. In turn, if the check result of Step 160 is affirmative (Y), Step 162 is undertaken to set the pointers P0–P3 to the top addresses of the respective part patterns. Then, the counter CLK is reset to "0". Consequently, the selected accompaniment pattern can be repeatedly reproduced. Thereafter, the processing returns to the main routine of FIG. 4. On the other hand, if the check result of Step 156 is affirmative (Y), Step 166 is undertaken to execute a subroutine of a combination pointer process or adjustive control process as shown in FIG. 8, thereafter returning to the main routine of FIG. 4.

Figure 8:
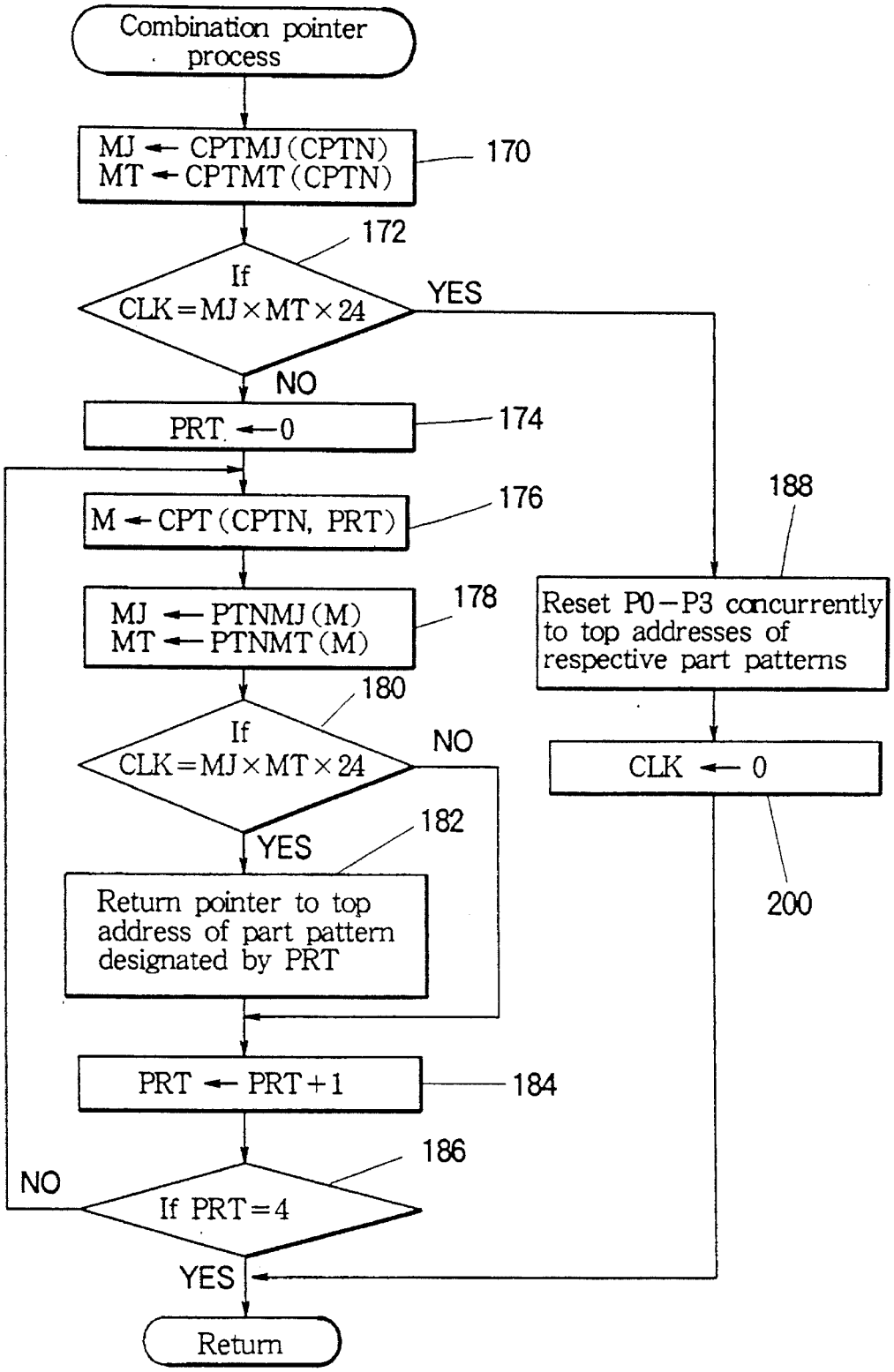
FIG. 8 is a flowchart showing a subroutine of a combination pointer process.

FIG. 8 shows the subroutine of the combination pointer process. Firstly in Step 170, the memory 24 is accessed to read out the measure number data CPTMJ(CPTN) and the beat number data CPTMT(CPTN) from the selected combination data identified by the content of the register CPTN. The read CPTMJ and CPTMT are written into the registers MJ and MT, respectively. Next, Step 172 is undertaken to check as to if the current value of the counter CLK reaches the product value of the measure number written in the register MJ, the beat number written in the register MT and the clock number "24" per one beat, the product value being representative of the end count of the longest part pattern. If this check result is negative (N), Step 174 is undertaken to set the value "0" to the register PRT. Subsequently in Step 176, the combination data memory 24 is accessed to retrieve therefrom the pattern number data CPT(CPTN,PRT) designated by the contents of the registers CPTN and PRT. The retrieved pattern number data CPT is written into the register M. Then, Step 178 is undertaken to access the accompaniment data memory 22 to read out the measure number data PTNMJ(M) and the beat number data PTNMT(M) from the accompaniment data designated by the pattern number written in the register M. The read values of PTNMJ(M) and PTNMT(M) are set to the registers MJ and MT, respectively. For example, if the register M indicates the accompaniment pattern number "1", the measure number data PTNMJ(1) and the beat number data PTNMT(1) of the accompaniment data AD(1) shown in FIG. 2 are retrieved from the memory 22, and are loaded into the registers MJ and MT, respectively.

Then, Step 180 is undertaken to check as to if the current value of the counter CLK reaches the product value of the measure number in the register M J, the beat number in the register MT and the clock number "24" per one beat, the product being representative of an end count of the Chord I part involved in the accompaniment pattern designated by the register M. If this check result is affirmative (Y), Step 182 is undertaken to set the pointer corresponding to the part number stored in the register PITT, to a top address of the associated part pattern. In the aforementioned example, when Step 182 is executed for the first time after Step 174, if the pointer P0 reaches the end address of the Chord I part pattern PP(1,0) involved in the accompaniment data AD(1), the pointer P0 is returned to the top address of the part pattern PP(1,0) in Step 182. Thereafter, Step 184 is undertaken to update the register PRT by one. Then, Step 186 is undertaken to check as to if the value of the register PRT reaches "4". When Step 186 is executed for the first time after Step 174, the check result of Step 186 is negative (N) since the value of the PRT is "1", thereby returning to Step 176. Thereafter, Steps 176–180 are again executed for the Chord II part designated by PRT="1". On the other hand, if the check result of Step 180 is negative (N), Step 184 is undertaken without the execution of Step 182. This means that the accompaniment reproduction is not yet ended for the Chord II part pattern PP(CPTN,1) belonging to the accompaniment data designated by the pattern number held in the register M. Thereafter, the value of PRT is incremented to "2" in Step 184. Then, the processing returns to Step 176 via Step 186. Again the above described operation is executed for the Bass part designated by PRT= "2". Such an operation is repeatedly carried out until the value of the register PRT reaches "4". Consequently, when each part pattern of the Chord I, Chord II, Bass and Drum involved in the selected combination pattern is ended, the same part pattern is again reproduced from the top thereof. Then, the check result of Step 186 turns affirmative (Y) when the value of PRT reaches "4", so that the processing returns to the FIG. 7 routine.

When the longest part pattern is ended while the remaining shorter part patterns are successively returned to their top addresses, the check result of Step 172 turns affirmative (Y). Consequently, Step 188 is undertaken so that all of the pointers P0–P3 are concurrently and compulsively shifted to the top addresses of the corresponding part patterns. Then, the counter CLK is reset to "0" in Step 200. Consequently, all of the four part patterns which constitute the selected free combination pattern are returned to the start points at once to repeat the same combination pattern. In this operation, until the longest part pattern is ended, the remaining shorter part patterns are separately recycled to repeat the same part patterns. Once the longest part pattern reaches its end, the remaining part patterns are forcibly shifted to the start point during the course of a middle of the accompaniment reproduction. Namely, the shorter part patterns having different pattern lengths are adjusted consistently to the longest part pattern to thereby achieve the repeated reproduction of the combination pattern. Lastly, the processing returns to the FIG. 7 routine after Step 200.

The present invention is not limited to the above described embodiment, but covers various modifications. For example, the memory 22 can be composed of a RAM such that the user can form and register original accompaniment patterns in the memory 22. Further, instead of repeating the shorter part patterns from their start points, each part pattern may be repeated from a middle section. Otherwise, the last measure may be selectively repeated.

As described above, according to the invention, a desired set of multiple part patterns are collected from different original accompaniment patterns of various styles to arrange the combination pattern. The collected part patterns are registered as the combination data or prescription data to thereby realize a wide variety of accompaniments by simplified registration operation. Further, the respective effective pattern lengths of the combined part patterns are adjusted identically with each other during the course of the accompaniment reproduction of the combination pattern. Therefore, different lengths of part patterns can be combined freely to form a variety of combination patterns. Moreover, shorter part patterns are adjusted according to the length of the longest part pattern, hence the longest part can be reproduced throughout the entire span.

Figure 9:
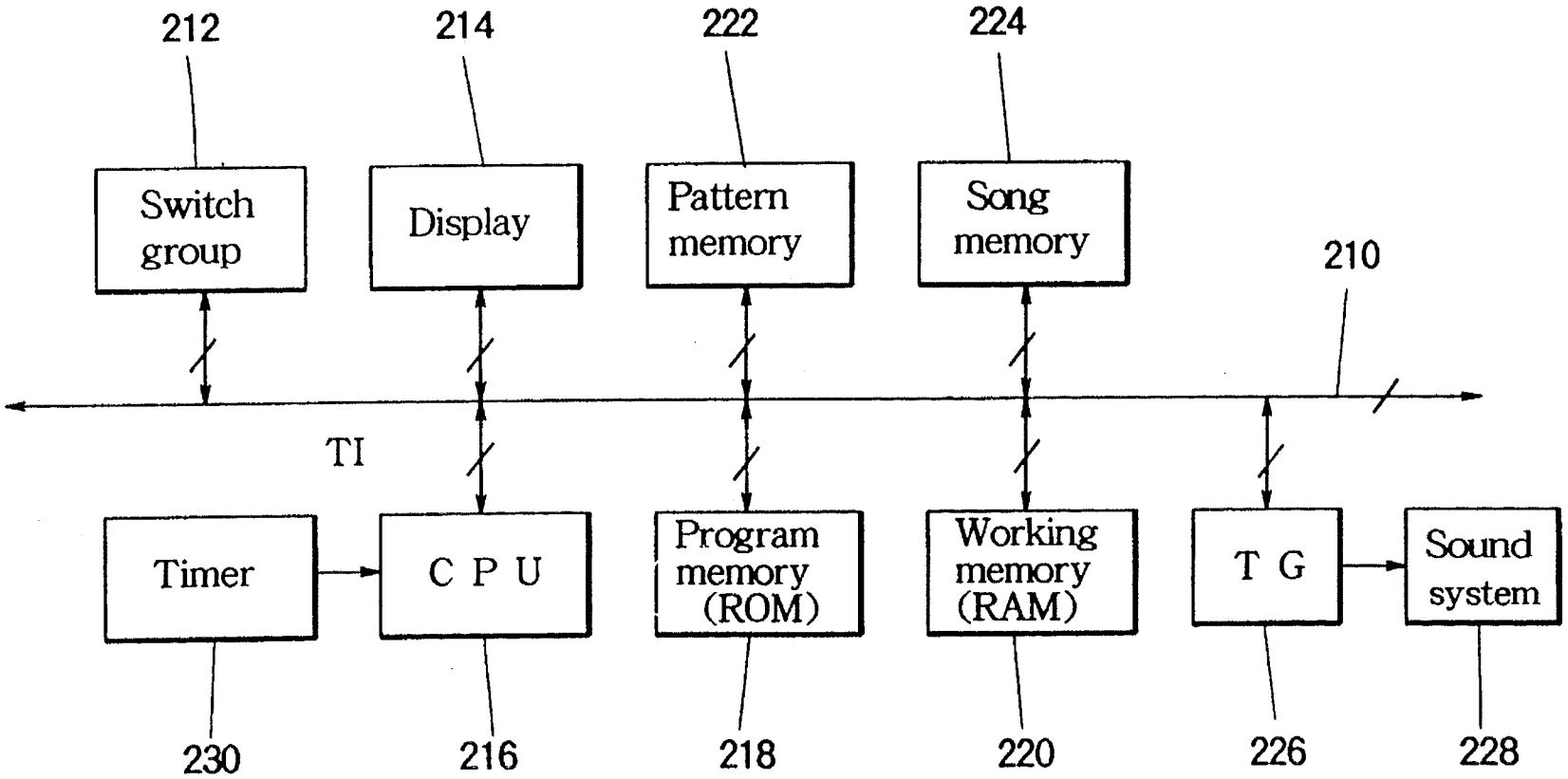
FIG. 9 is a block diagram showing a second embodiment of the inventive accompaniment apparatus installed in the electronic musical instrument.

FIG. 9 is a block diagram showing the second embodiment of the inventive electronic musical instrument having an automatic arrangement function and an automatic performance function, which are effected under the control by a microcomputer. In the FIG. 9 diagram, each signal line marked by a slash indicates a multiple signal channel. Further, in the following descriptions, a meter is represented in terms of a beat number where one beat denotes a quarter note. For example, the ¾ meter is represented by "three-beat".

In the above construction, a bus line 210 is provided to connect a switch group 212, a display 214, a central processing unit (CPU) 216, a program memory 218, a working memory 220, a pattern memory 222, a song memory 224, a tone generator (TG) 226 and so on.

The switch group 212 includes various switches disposed on a panel face of the musical instrument. These switches are scanned in a multiplex manner to detect inputted operational information. Hereinbelow, the following six switches are involved in connection with the inventive aspect of the present embodiment.

(1) A song select switch, which is provided for selecting a desired song to be arranged or performed.

(2) An arrangement mode switch, which is provided for selecting an arrangement mode.

(3) A start/stop switch, which is provided for commanding start and stop of the automatic performance.

(4) Chord designation switches, which are utilized to designate a root note and a type of chords such as C Major and E Minor.

(5) A ten-key, which is utilized to input a measure number, a style code, a beat number and offer inputs for the selected song to be arranged or edited, and to set time information for the inputted chords.

(6) A tone color setting switch, which is utilized to set a desired timbre for each of an Obbligato part, a Chord backing part and a Bass part.

The display 214 indicates various prescription data with regard to the automatic arrangement and the automatic performance. For example as shown in FIG. 10, the display 214 indicates inputted information of a composition of a song to be edited in the arrangement mode. In the FIG. 10 example, four serial performance sections A–D are displayed with respect to a song No. 3. Further, a measure number, a style code and a beat number are indicated for each performance section. For example, with regard to the first section A, the measure number is indicated "4", the style code is indicated "3", and the beat number is indicated "¾". The style code designates a particular style such as the style code "3" denotes a waltz.

Referring back to FIG. 9, the CPU 216 operates according to a control program stored in the program memory 218 composed of a ROM to conduct the various processings in the automatic arrangement and the automatic performance. These processings will be described later in conjunction with FIGS. 14–18. In this regard, the working memory 220 is composed of a RAM, and includes memory areas for use as registers and counters in the various processings by the CPU 216. Later, description will be given to particular registers associated with the present embodiment. The pattern memory 222 is composed of a ROM which memorizes a set of four parallel parts of original performance pattern data, i.e., Obbligato, Chord backing, Bass and Drum (Rhythm) for each of different styles. The data format of the ROM will be described later in conjunction with FIG. 12. The song memory 224 is composed of a RAM which can store combined four parts of the performance data for a selected song. The data format of the RAM will be described later in conjunction with FIG. 13.

The tone generator 226 is provided with a plurality of tone generating channels for concurrently generating musical tone signals of the four parallel parts. These musical tone signals from these channels are converted into a musical sound by a sound system 228. A timer 230 feeds an interruption command signal TI to the CPU 216. The signal TI is periodically generated every interruption timing corresponding to 96-th note within one measure. The CPU 216 operates whenever the interruption command signal TI is received for initiating an interruption routine of FIG. 18.

Figure 11:
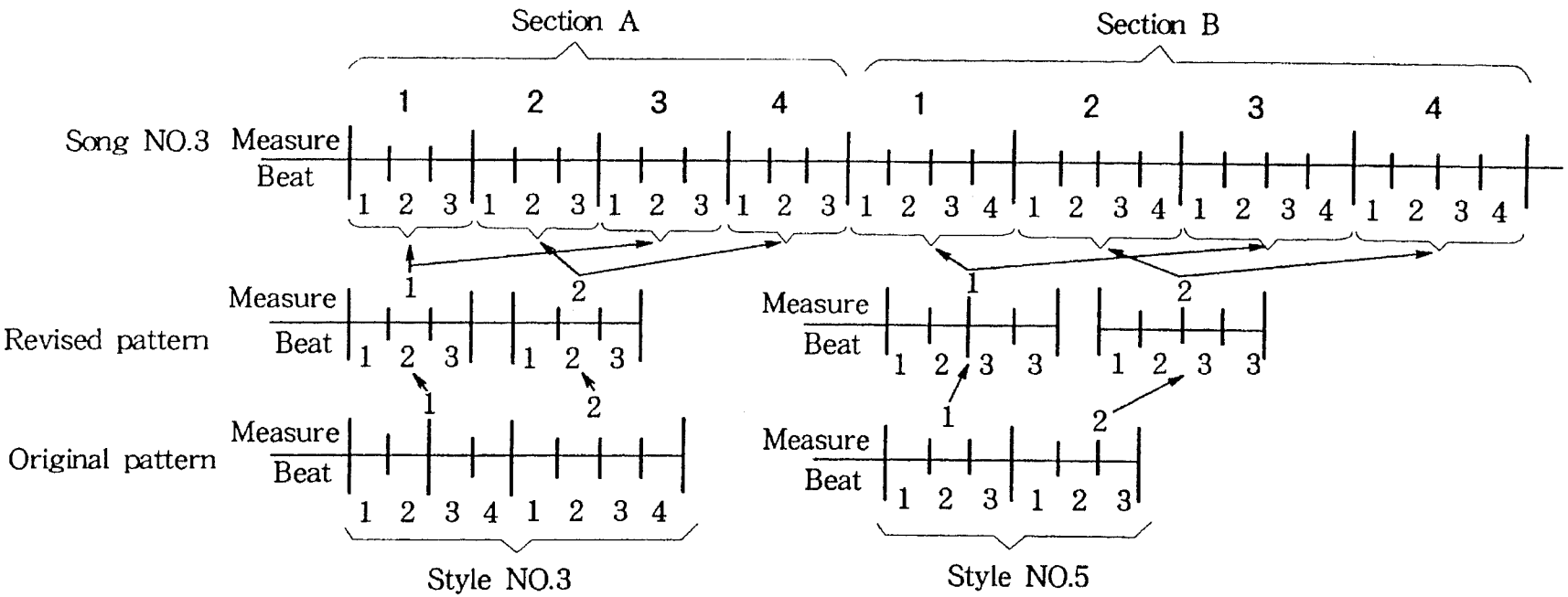
FIG. 11 is a timing chart illustrating a basic operation of arranging a song in the second embodiment.

Next, the brief description will be given to the basic song arrangement operation of the FIG. 9 instrument in conjunction with FIG. 11. This diagram illustrates an automatic arrangement procedure in the serial sections A and B of the song No. 3 shown in FIG. 10. In this case, the pattern memory 222 is accessed to read out one original performance pattern of style No. 3 having two measures of four-beat, and another original performance pattern of style No. 5 having two measures of three-beat. With regard to the first section A, the ¾ meter is designated as shown in the FIG. 10 table, hence the original pattern of the style No. 3 is read out while skipping the fourth beat each measure to prepare a corresponding adjusted or revised pattern. The first measure of the revised pattern is distributed to the first and third measures of the section A, and the second measure of the same revised pattern is distributed to the second and fourth measures of the same section A. Thus, the section A can be arranged in ¾ meter as specified, and the arranged result is registered in the song memory 224. With regard to the subsequent section B where the ⁴⁄₄ meter is assigned as shown in the FIG. 10 table, the original pattern of style No. 5 is read out such that the third beat is repeated or twice sampled each measure to form a corresponding revised pattern as shown in FIG. 11. The first measure of this revised pattern is distributed to the first and third measures of the section B, and the second measure of the same revised pattern is distributed to the second and fourth measures of the same section B to thereby achieve the ⁴⁄₄ measure as specified. The arranged result is registered in the song memory 224.

Figure 12:
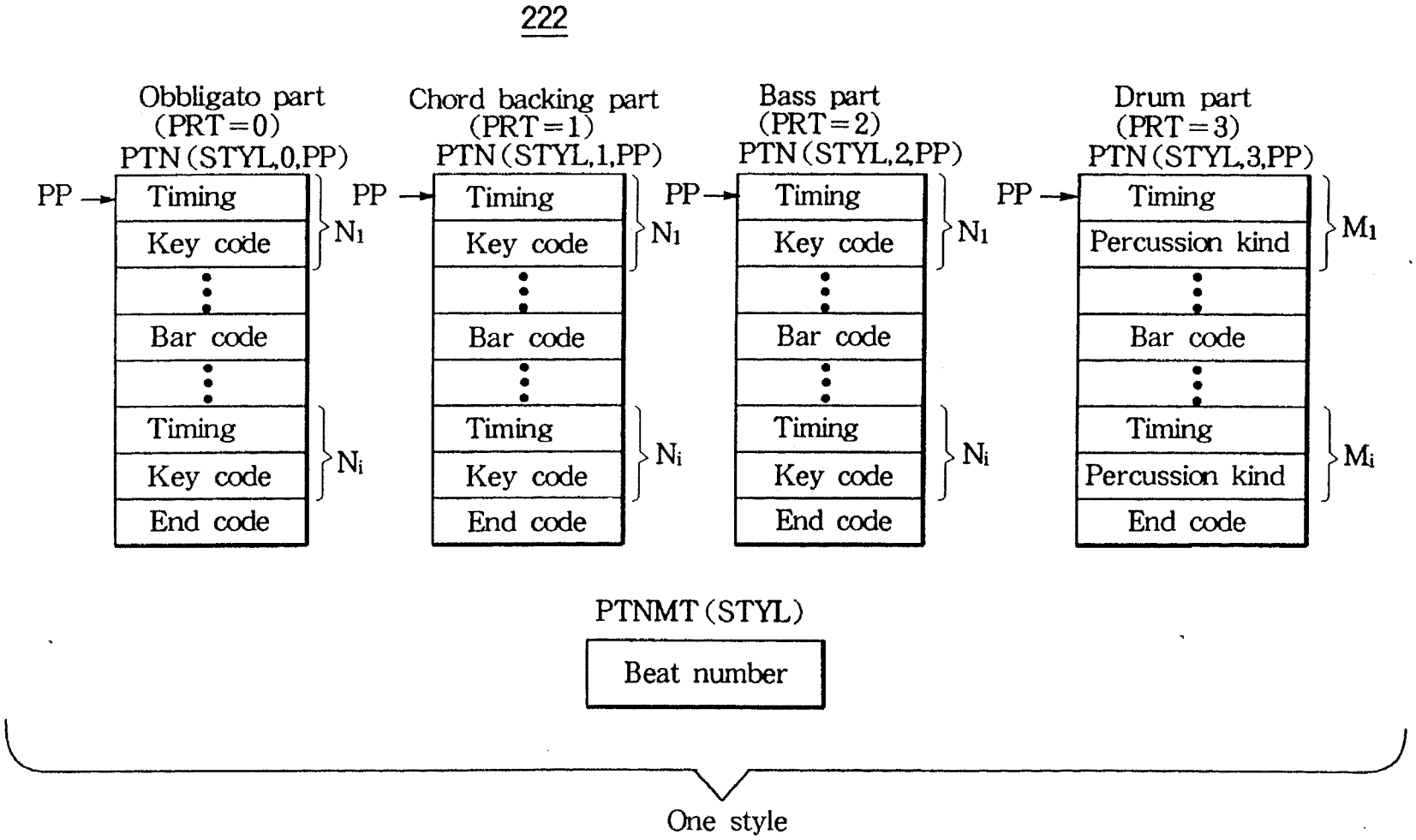
FIG. 12 is a diagram showing an accompaniment pattern data format of the second embodiment.

FIG. 12 shows the data format of the pattern memory 222. The memory 222 stores a set of original performance pattern data PTNs corresponding to the four parts of Obbligato, Chord backing, Bass and Drum for each style, and a meter data PTNMT which indicates a beat number of the performance pattern represented by the data PTN. The performance pattern of each part has a certain length, for example, of two measures. The performance pattern data of the Obbligato part is comprised of a sequence of events corresponding to musical tones N1-Ni to be generated. Each event contains a timing data and a key code data. Further, the pattern data contains a bar code data at the end of the first measure and an end code data at the end of the second measure. Each timing data indicates a tone generating timing and is represented in terms of a count of the interruption command signal TI within one measure. The count ranges from "0" to "71" in case of the ¾ meter, and ranges from "0" to "95" in case of the ⁴⁄₄ meter. Each key code data represents a pitch of the musical tone. The performance pattern data of the Chord backing and Bass parts has the same format as the above described Obbligato part. On the other hand, the performance pattern data of Drum part is comprised of a sequence of events representative of rhythm tones M1-Mi. Each event contains a timing data and a percussion kind data. The Drum performance pattern data further contains a bar code data at the end of the first measure, and an end code data at the end of the second measure. Each timing data is similar to that of the Obbligato part and each percussion kind data represents a rhythm tone to be generated, in terms of a percussion name such as a drum and a cymbal.

Figure 13:
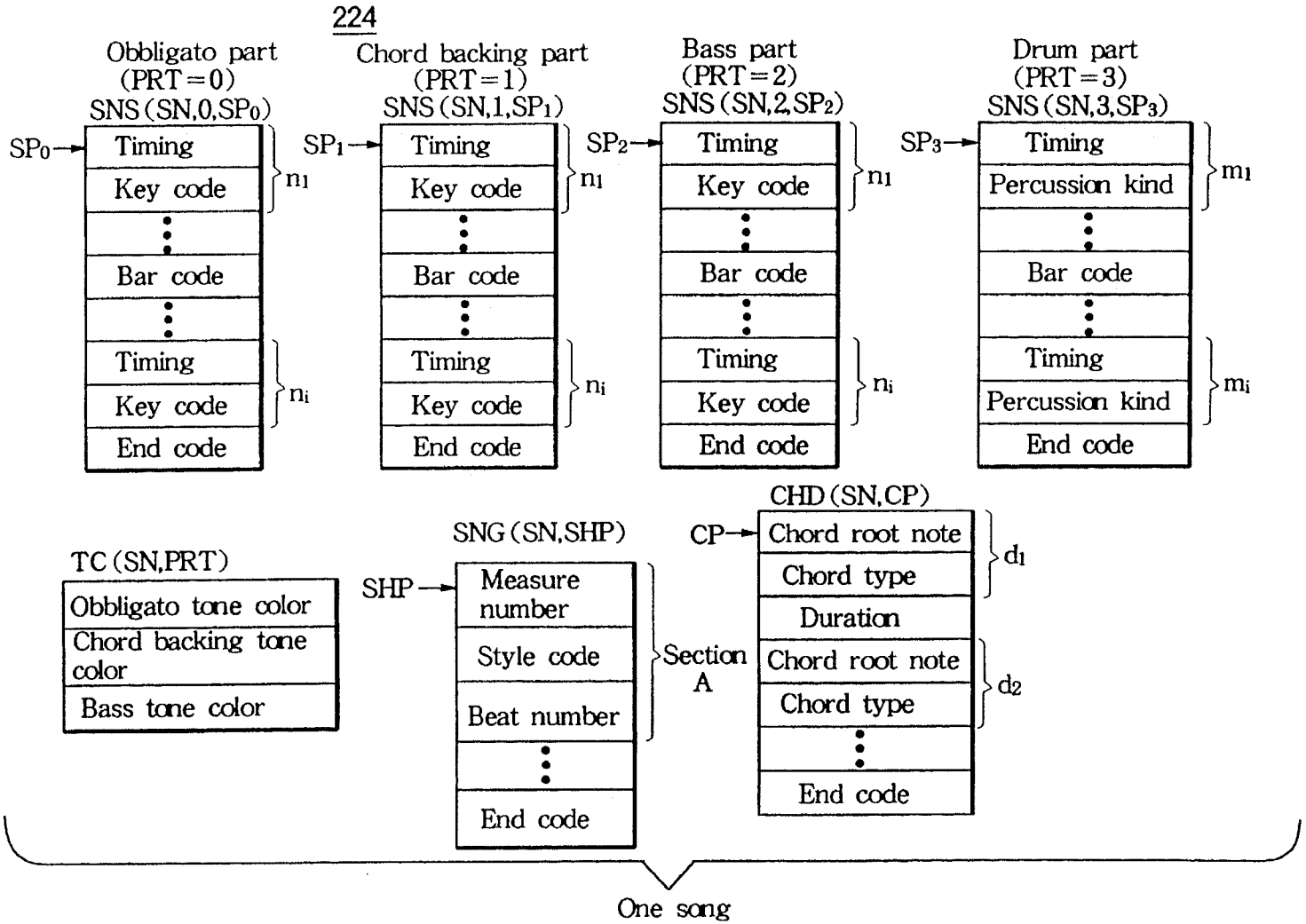
FIG. 13 is a diagram showing a serial accompaniment pattern data format of the second embodiment.

FIG. 13 shows a data format of the song memory 224. This memory 224 registers, for each song, a set of song data SNSs corresponding to the four parts of Obbligato, Chord backing, Bass and Drum, a tone color data TC of the four parts, a song composition data SNG, and a chord progression data CHD. The song data SNS of each part is formed such that the performance pattern data of the corresponding part is read out from the pattern memory 222 to arrange in time sequential manner as exemplified in FIG. 11. The data format of the song data represents musical tones n1-ni and rhythm tones m1-mi as exemplified in FIG. 12. The tone color data TC indicates timbres of the three parts of Obbligato, Chord backing and Bass. The timbres of these three parts are set by the foregoing timbre setting switches. The song composition data SNG contains the measure number data, style code data and beat number data for the serial sections A–D as indicated by FIG. 10. The data SNG further contains an end code data at the end of the sequence. For example, with regard to the section A, the song composition data SNG contains the measure number "4", the style code "3" and the beat number "3" indicative of ¾ meter. Those of measure number, style code and beat number are inputted by the ten-key. The chord progression data CHD represents a sequence of chords d1, d2, . . . . The data CHD contains a pair of chord root note data and chord type data for each of the sequential chords, and a duration data indicative of a time interval between adjacent chords. Further, the data CHD contains an end code data at the end of the sequence. These chord root note data and chord type data are inputted by the foregoing chord designation switches, and the duration data is inputted by the ten-key or else.

The working memory 220 includes the following registers (1)–(14) and others particularly associated with the inventive feature of the present embodiment:

(1) A song code register SN, which is set with a song code selected by the song select switch.

(2) A run flag RUN, which is a one-bit register settable with either of "1" indicating a running state of the automatic performance, and "0" indicating a suspended state of the automatic performance.

(3) A tempo clock counter CLK, which counts the interruption command signal TI generated from the timer 230 as a tempo clock. The counted value increments from "0" to "beat number×24" within one measure. The counter CLK is reset to "0" when the counted value reaches "beat number× 24".

(4) A measure number counter M, which counts a number of measures in the automatic arrangement mode and the automatic performance mode.

(5) A pattern beat number register PMTR, which stores the beat number data PTNMT read out from the memory 222 shown in FIG. 12.

(6) A measure number register MJN, which stores the measure number data taken from the song composition data SNG registered in the memory 224 shown in FIG. 13.

(7) A style code register STYL, which stores the style code data taken from the song composition data SNG registered in the memory 224 shown in FIG. 13.

(8) A song beat number register MTR, which stores the beat number data taken from the song composition data SNG registered in the memory 224 shown in FIG. 13.

(9) A part number register PRT, which is settable with a part number "0"–"3" used during the course of reading data from the memory 222 of FIG. 12, and during the course of processing data registered in the memory 224 of FIG. 13. The part number "0" indicates Obbligato part, the part number "1" indicates Chord backing part, the part number "2" indicates Bass part, and the part number "3" indicates Drum part.

(10) A pattern memory address pointer PP, which indicates a reading address of the pattern memory 222 as shown in the FIG. 12 data format.

(11) Song part address pointers SP0–SP3, which indicate addresses of the respective song data SNSs of the four parts registered in the song memory 224, as shown in FIG. 13.

(12) A song composition address pointer SHP, which indicates an address of the song composition data SNG registered in the song memory 224 as shown in the FIG. 13 data format.

(13) A chord progression address pointer CP, which indicates an address of the chord progression data CHD registered in the song memory 224, as shown in the FIG. 13 data format.

(14) A repeat reading start timing register AT, which stores a repeat reading start timing data for use in repeated reading of a portion of the performance pattern data from the memory 222.

Figure 14:
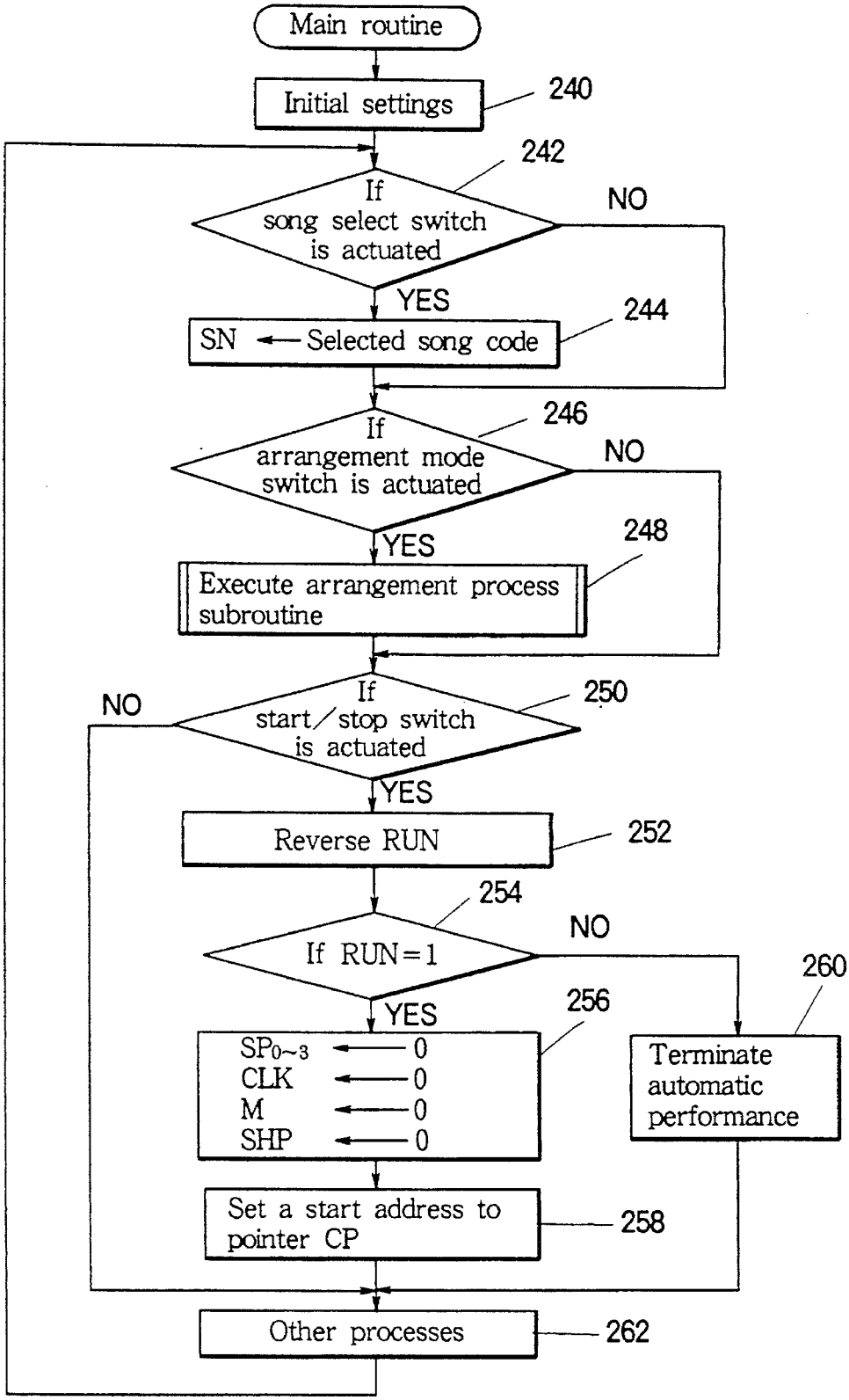
FIG. 14 is a flowchart showing a main routine of the second embodiment.

FIG. 14 shows a flowchart of a main routine, which is commenced in response to power-on or other actions of the musical instrument. Firstly, Step 240 is undertaken to carry out initial setting process such that the foregoing registers and others are initialized. Subsequently, Step 242 is undertaken to check as to if the song select switch is actuated. If this check result is affirmative (Y), Step 244 is undertaken to set a selected song code to the register SN. After the processing of Step 224 is finished or when the check result of Step 242 is negative (N), Step 246 is undertaken to check as to if the arrangement mode switch is turned on. If this check result is affirmative (Y), Step 248 is undertaken to execute a song arrangement process subroutine as will be described later in conjunction with FIG. 15. After the arrangement process of Step 248 is finished or when the check result of Step 246 is held negative (N), Step 250 is undertaken to check as to if the start/stop switch is actuated. If this check result is affirmative (Y), Step 252 is undertaken to reverse the run flag RUN from "0" to "1" or vice versa. Then, Step 254 is undertaken to check as to if the run flag RUN is set with "1". If this check result is affirmative (Y), Step 256 is undertaken to set "0" to all of the pointers $SP_0$–$SP_3$ and SHP, and the counters CLK and M. Then, Step 258 is undertaken to set a start address to the pointer CP. These processings are carried out for preparation of the automatic performance. In turn, if the check result of Step 254 turns negative (N), Step 260 is undertaken to carry out a silencing process. Namely, the tone generator 226 is controlled to start attenuation of all the generated tone signals. Consequently, the automatic performance is suspended or terminated. After either process of Steps 258 and 260 is finished or when the check result of Step 250 is held negative (N), Step 262 is undertaken to carry out other processings. Then, the main routine returns to Step 242 to repeatedly carry out the above described operation.

Figure 15:
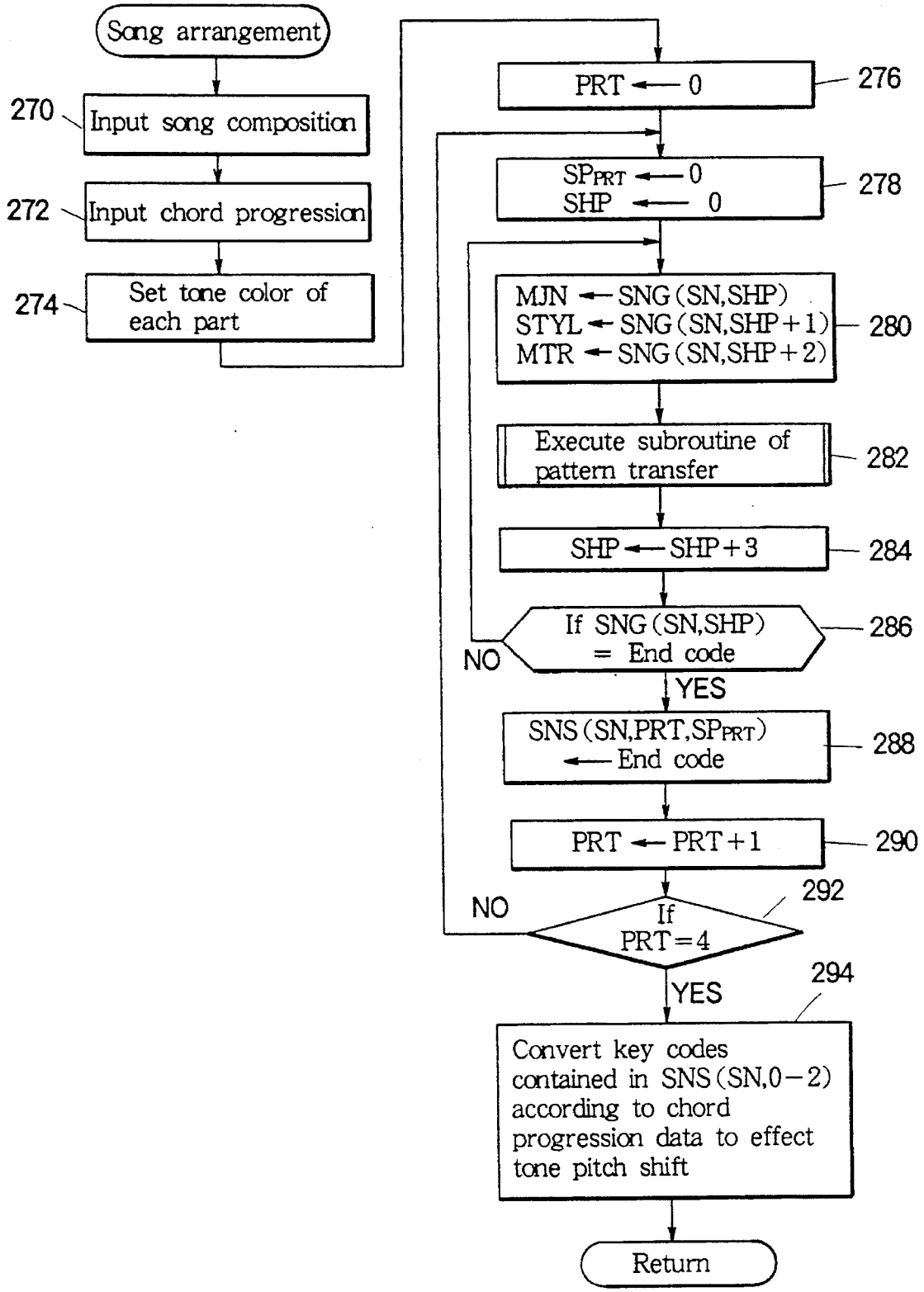
FIG. 15 is a flowchart showing a subroutine of a song arrangement process.

FIG. 15 shows the subroutine of the song arrangement. Firstly, Step 270 is undertaken to execute a song composition input process. Namely, the ten-key is operated to input a set of measure number, style code, beat number and other for each of the serial sections A–D of the selected song designated by the song code held in the register SN. The thus inputted information is registered in the song memory 224 as illustrated by FIG. 13, and is indicated by the display 214 as described in conjunction with FIG. 10. Next, Step 272 is undertaken to execute a chord progression input process. Namely, the chord designation switches are operated to sequentially input a set of a chord root note and a chord type of each desired chord, and the ten-key or other is actuated to input a duration between adjacent chords. The thus inputted chord progression data is registered in the memory 224 as illustrated by FIG. 13. Next, Step 274 is undertaken to execute a tone color setting process for each part. Namely, the tone color setting switches are selectively operated to set desired tone colors for the respective parts of Obbligato, Chord backing and Bass. These tone color data are registered in the memory 224 as illustrated by FIG. 13.

Subsequently, Step 276 is undertaken to set the part number "0" in the register PRT to initially designate the Obbligato part. Then, Step 278 is undertaken to set "0" to a pointer $SP_{PRT}$ designated by PRT. Concurrently, the pointer SHP is set to "0". Thereafter, Step 280 is undertaken to access the memory 224 to read out therefrom the song construction data SNG(SN,SHP), SNG(SN,SHP+1) and SNG(SN,SHP+2) of one section, which are stored into the registers MJN, STYL and MTR, respectively. In this case, the SNG(SN,SHP) represents a measure number designated by both of the song code stored in the register SN and the address value of the pointer SHP. The SNG(SN,SHP+1) represents a style code stored in an address next to the above measure number data. The SNG(SN,SHP+2) represents a beat number stored in an address next to the above style code data. When Step 280 is undertaken for the first time after Step 276, the set of song composition data of the first section (e.g., the section A in the FIG. 10 example) is retrieved from the memory 224, and is loaded into the set of registers MJN, STYL and MTR. Next, Step 282 is undertaken to execute a subroutine of a pattern transfer process which will be described later in conjunction with FIG. 16. In this subroutine, the memory 222 is accessed to read out therefrom a performance pattern data of the part designated by the registers PRT and STYL. The read performance pattern data is arranged time-sequentially to form a song data of one section, using the registers MJN, MTR and else. For example, the Obbligato part of the section A is formed at the first cycle, as shown in FIG. 10. The formed song data is transferred to the memory 224. Then, Step 284 is undertaken to update the address value of the pointer SHP by "3" to thereby shift to a next section. Further, Step 286 is undertaken to check as to if the song composition data SNG(SN, SHP) designated by the song number SN and the address pointer SHP is an end code data. When Step 286 is undertaken for the first time after Step 276, the current data SNG(SN,SHP) is the measure number data of the next section B in the FIG. 10 example since the first section A has been just finished. Thus, the check result of Step 286 is held negative (N). In this case, the routine returns to Step 280 to repeatedly carry out the above described operation.

By repeating the operation, lastly the song edition is completed from the section A to section D. After the last section D is finished in Step 282, the pointer SHP is updated by "3" in Step 284 so that the pointed song composition data SNG(SN,SHP) indicates the end code data. Thus, the check result of Step 286 turns affirmative (Y) to thereby proceed to Step 288. In this step, an end code data is written into a memory location SNS(SN,PRT,$SP_{PRT}$) of the memory 224, which is designated by the song number SN, the part number PRT and the pointer $S_{PRT}$. For example, when Step 288 is undertaken for the first time after Step 276, the end code data is written into a memory location next to the last one of the Obbligato part song data in the memory 224. Next, Step 290 is undertaken to increment the register PRT by "1". When Step 290 is carried out for the first time after Step 276, the value of PRT is updated to "1" to thereby designate the next Chord backing part. Subsequently, Step 292 is undertaken to check as to if the value of the register PRT reaches "4". When Step 292 is carried out for the first time after Step 276, the value of PRT is "1" so that the check result of Step 292 is negative (N). In this case, the routine returns to Step 278 to repeatedly carry out the subsequent steps. By the repeated operation, the remaining parts of Chord backing, Bass and Drum are successively edited. In Step 288, the end code data is added to the last of the song data of the Drum part. Thereafter, the value of the register PRT is incremented by one to thereby reach "4". Consequently, the check result of Step 292 turns affirmative (Y) to thereby proceed to Step 294. In this step, each key code contained in the song data SNS(SN,0), SNS(SN,1) and SNS(SN,2) designated by the song number SN and the part numbers "0"–"2", is subjected to a tone pitch conversion process according to the chord data (including chord root note data and chord type data) selected from the chord progression data in correspondence to each key code. The converted results are written back into the memory 224. In this conversion, some of the key codes remain unchanged if the corresponding chord data does not require a tone pitch shift. After Step 294, the processing returns to the main routine of FIG. 14.

Figure 16:
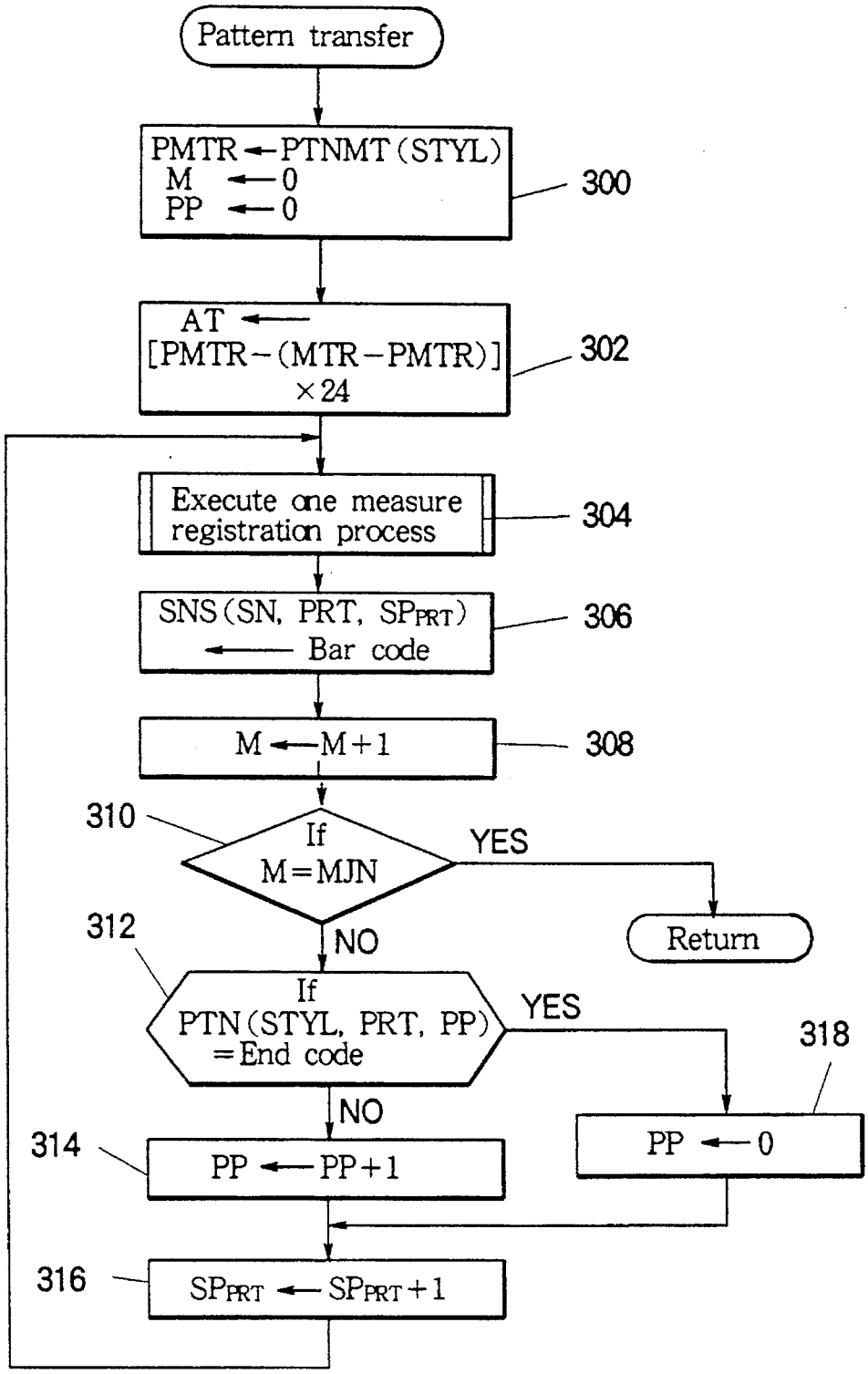
FIG. 16 is a flowchart showing a subroutine of a pattern transfer process.

FIG. 16 shows the subroutine of the pattern transfer process. Firstly, Step 300 is undertaken to access the memory 222 to read out therefrom the beat number data PTNMT(STYL) designated by the style number held in the register STYL, and the read data PTNMT is stored in the register PMTR. Further, the counter M and the pointer PP are set to the initial value "0". Subsequently, Step 302 is undertaken to produce the repeat reading start timing data which is stored in the register AT for use in repeated reading of a portion of the performance pattern data from the memory 222. In this case, the repeat reading start timing data is represented by AT=[PMTR−(MTR−PMTR)]× 24, where AT, PMTR and MTR represent the value of the correspondingly labeled registers AT, PMTR and MTR. For example, provided that MTR=4 and PMTR=3 as exemplified in the section B of FIG. 11, AT=[3−(4−3)]× 24=48 so that the repeat reading start timing indicates a top of the third beat. Stated otherwise, the third beat of the original pattern is sampled twice to form the adjusted pattern. Then, Step 304 is undertaken to execute a subroutine of one measure registration process, which will be described later in conjunction with FIG. 17. In this subroutine, one measure length of the performance pattern data is read out from the pattern memory 222, and the read data is memorized in the song memory 224 as one measure length of the song data. Thereafter, Step 306 is undertaken to write a bar code data into a memory location SNS(SN,PRT,$SP_{PRT}$) of the memory 224, which is designated by the song number SN, part number PRT and the pointer $SP_{PRT}$. Consequently, the bar code data is added to the end of the one measure in the song data. Then, Step 308 is undertaken to increment the counter M by one.

Subsequent Step 310 is undertaken to check as to if the value of the counter M coincides with the value of the register MJN so as to determine if a designated number of the measures are transferred from the memory 222 to the memory 224. For example, in the section A of FIG. 10 where the measure number is set to "4", the check result of Step 310 is held negative (N) since the counter M is incremented to "1" in Step 308 for the first time, thereby proceeding to Step 312. In this step, check is made as to if an event data PTN(STYL,PRT,PP) accessed by the style number STYL, part number PRT and pointer PP indicates an end code within the memory 222. In the above described example, when Step 312 is undertaken for the first time after the value of the counter M is turned to "1", the event data PTN(SN, PRT,PP) indicates the bar code data at the end of the first measure—not the end code data. Consequently, the check result of Step 312 is held negative (N) to thereby proceed to Step 314. In this step, the pointer PP is incremented by one. Further, Step 316 is undertaken to increment the other pointer $SP_{PRT}$ by one, which is designated by the part number stored in the register PRT. Thereafter, the processing returns to Step 304 to thereby repeatedly carry out the above described operation. In such an operation, when Step 312 is undertaken after the counter M is incremented to "2", the check result thereof turns to affirmative (Y) to thereby proceed to Step 318. In this step, the pointer PP is reset to "0". Consequently, the reading of the two-measure pattern is continued from the end of the second measure to the top of the first measure in the pattern memory 222. After Step 318, the pointer $SP_{PRT}$ is incremented by one in Step 316, thereby returning to Step 304. After repeating the above described pattern transfer operation several times, the check result of Step 310 turns affirmative (Y) to thereby return to the routine of FIG. 15. For example in the section A of FIG. 10, when the counter M reaches the value "4", the check result of Step 310 turns affirmative (Y).

Figure 17:
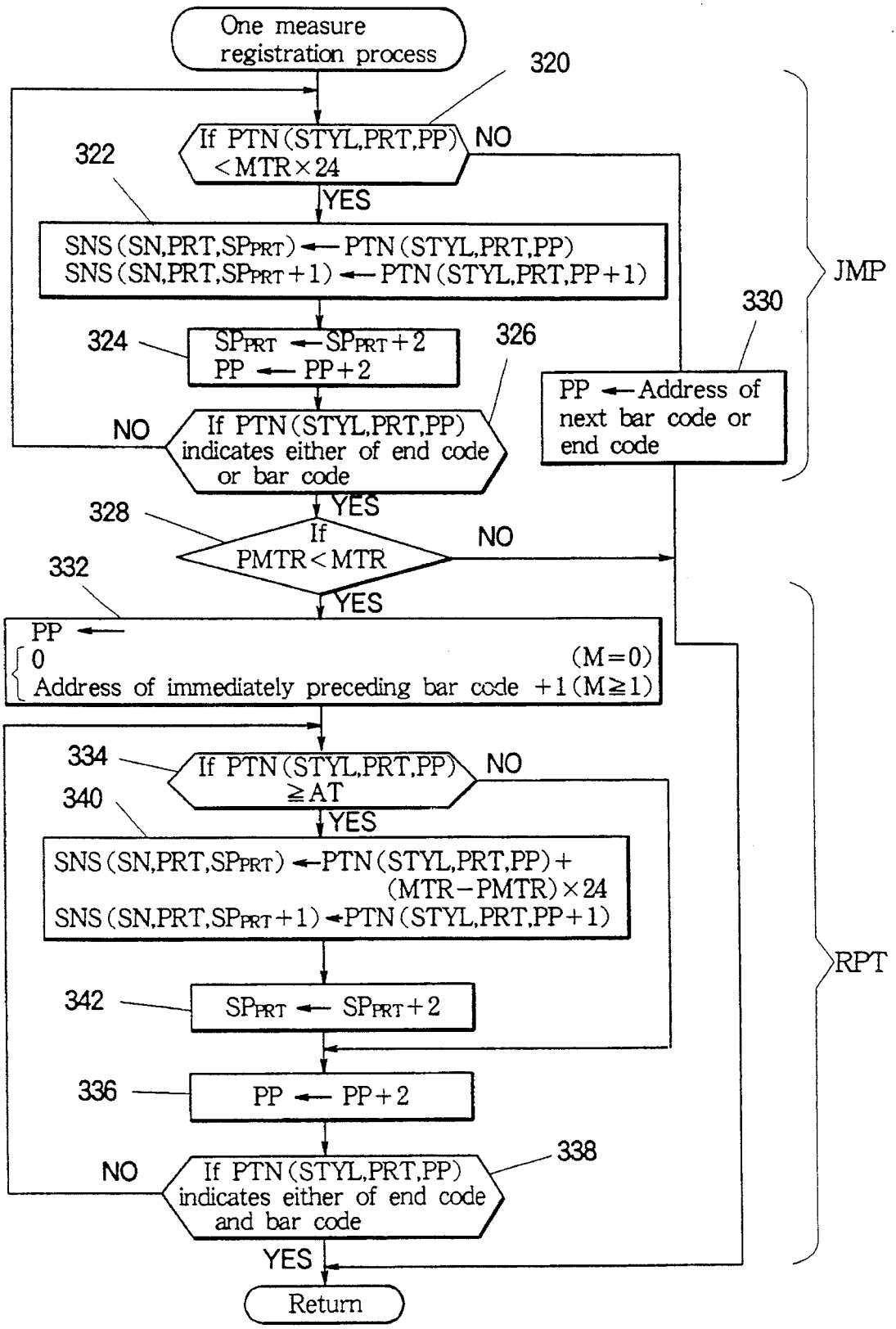
FIG. 17 is a flowchart showing a subroutine of one measure registration process.

FIG. 17 shows the subroutine of the one measure memorization process. Firstly, Step 320 is undertaken to check as to if a timing data PTN(STYL,PRT,PP) designated by the style number STYL, the part number PRT and the pointer PP is less than the product of the designated beat number stored in the register MTR and the clock number "24". Stated otherwise, the check is made as to determine if the current timing is within one measure corresponding to the designated beat number. If this check result is affirmative (Y), subsequent Step 322 is undertaken. In this step, the timing data PTN(STYL,PRT,PP) is transferred from the pattern memory 222 to the song memory 224 to load into a memory location SNS(SN,PRT,$SP_{PRT}$) designated by the song number SN, the part number PRT and the writing pointer $SP_{PRT}$. Concurrently, a key code data or percussion kind data PTN(STYL,PRT,PP+1) next to the timing data PTN(STYL, PRT,PP) is written into a next memory location SNS(SN, PRT,$SP_{PRT}$+1). Then, Step 324 is undertaken to update both of the writing pointer $SP_{PRT}$ and the reading pointer PP by "2". Further, Step 326 is undertaken to check as to if the currently read data PTN(STYL,PRT,PP) denotes either of an end code and a bar code. When Step 326 is carried out for the first time after Step 300 of FIG. 16, the first tone data is just read out so that the check result of Step 326 is held negative (N). In this case, the routine returns to Step 320 to repeat the following steps. After repeating this operation several times, the check result of Step 320 is turned negative (N) when the data transfer of the designated beat number is finished to thereby proceed to Step 330, provided that, for example in the section A of FIG. 11, the beat number "4" of the original performance pattern is greater than the designated beat number "3". In Step 330, the pointer PP is set to an address of a next bar code data or next end code data. Such a sequential process JMP from Step 320 to Step 330 is conducted to jump or skip an excess portion of the pattern data, which ranges between the last timing data PTN(STYL, PRT,PP) and the next bar code or end code data. By this process JMP, the three beat song data can be arranged from the four beat pattern data as exemplified in the section A of FIG. 11. After Step 330, the present routine returns to the FIG. 16 routine.

On the other hand, in case that the beat number of the original pattern is less than or equal to the designated beat number, after the last tone data of one measure is read out in Step 322, subsequent Step 326 is carried out to examine a following data PTN(STYL,PRT,PP) which should be a bar code data. Consequently, the check result of Step 326 turns affirmative (Y). Subsequently, check is made in Step 328 as to if the value of the register PMTR representative of the original or initial beat number is less than the value of the register MTR representative of the designated beat number. The check result is found affirmative (Y) in case of, for example, the section B of FIG. 11 where PMTR="3" and MTR="4", thereby proceeding to Step 332. Otherwise, the check result is found negative (N) in case that the initial beat number coincides with the designated beat number, thereby returning to the FIG. 16 routine.

In Step 332, the reading pointer PP is reset to "0" in case that the counter M indicates "0" which means the first measure. Otherwise, the reading pointer PP is shifted to the address of "an immediately preceding bar code plus one" in case that the counter M indicates "1" or more which means the second or further measure. Then, Step 334 is undertaken to check as to if the current timing data PTN(STYL,PRT,PP) is greater than or equal to the repeat reading start timing stored in the register AT. When Step 334 is undertaken for the first time after the pointer PP is set to the address of the first timing data within the measure in Step 332, the check result of Step 334 is held negative (N) to thereby proceed to Step 336. In this step, the pointer PP is updated by "2". Then, Step 338 is undertaken to check as to if the current data PTN(STYL,PRT,PP) indicates either of the end code or the bar code. When Step 338 is carried out for the first time after Step 332, the current data PTN(STYL,PRT,PP) is a second timing data in the one measure so that the check result of Step 338 is held negative (N). In this case, the routine returns to Step 334 to thereby repeat the above operation. For example in the section B of FIG. 11, after repeating the above operation for certain times, the check result of Step 334 is turned affirmative (Y) at a top timing of the third beat in the performance pattern to thereby proceed to Step 340. In this step, the memory 222 is accessed to read out therefrom the current timing data PTN(STYL,PRT,PP) and the subsequent key code data or percussion kind data PTN(STYL,PRT,PP+1). Further, the timing data PTN(STYL,PRT,PP) is added with a certain value (MTR−PMTR)×24. For example, in case of the designated beat number MTR="4" and the original beat number PMTR="3", the value of the timing data PTN(STYL,PRT,PP) is converted into a shifted value within the fourth beat by adding the tempo clock number 24. Then, the song memory 224 is accessed such that the shifted timing data [PTN(STYL,PRT, PP)+(MTR−PMTR)×24] is written into an assigned memory location SNS(SN,PRT,$SP_{PRT}$), and the associated key code data or percussion kind data PTN(STYL,PRT,PP+1) is written into a next memory location SNS(SN,PRT,$SP_{PRT+}$1). Thereafter, Step 342 is undertaken to update the writing pointer $SP_{PRT}$ by "2". Further, the reading pointer PP is updated by "2" to thereby proceed to Step 338. In manner similar to the previous operation, the check is made as to if the current data PTN(STYL,PRT,PP) indicates either of an end code or a bar code. If this check result is negative (N), the routine returns to Step 334. Otherwise, if the check result is affirmative (Y), the routine returns to the FIG. 16 routine. Such a sequential process RPT from Step 332 to Step 338 is conducted to read again a portion of the performance pattern after the same has been read out completely through one measure so as to add the again read portion to the one measure of the previously read pattern. By such a process RPT, for example in the section B of FIG. 11, the four beat song data can be formed from the three beat performance data.

Figure 18:
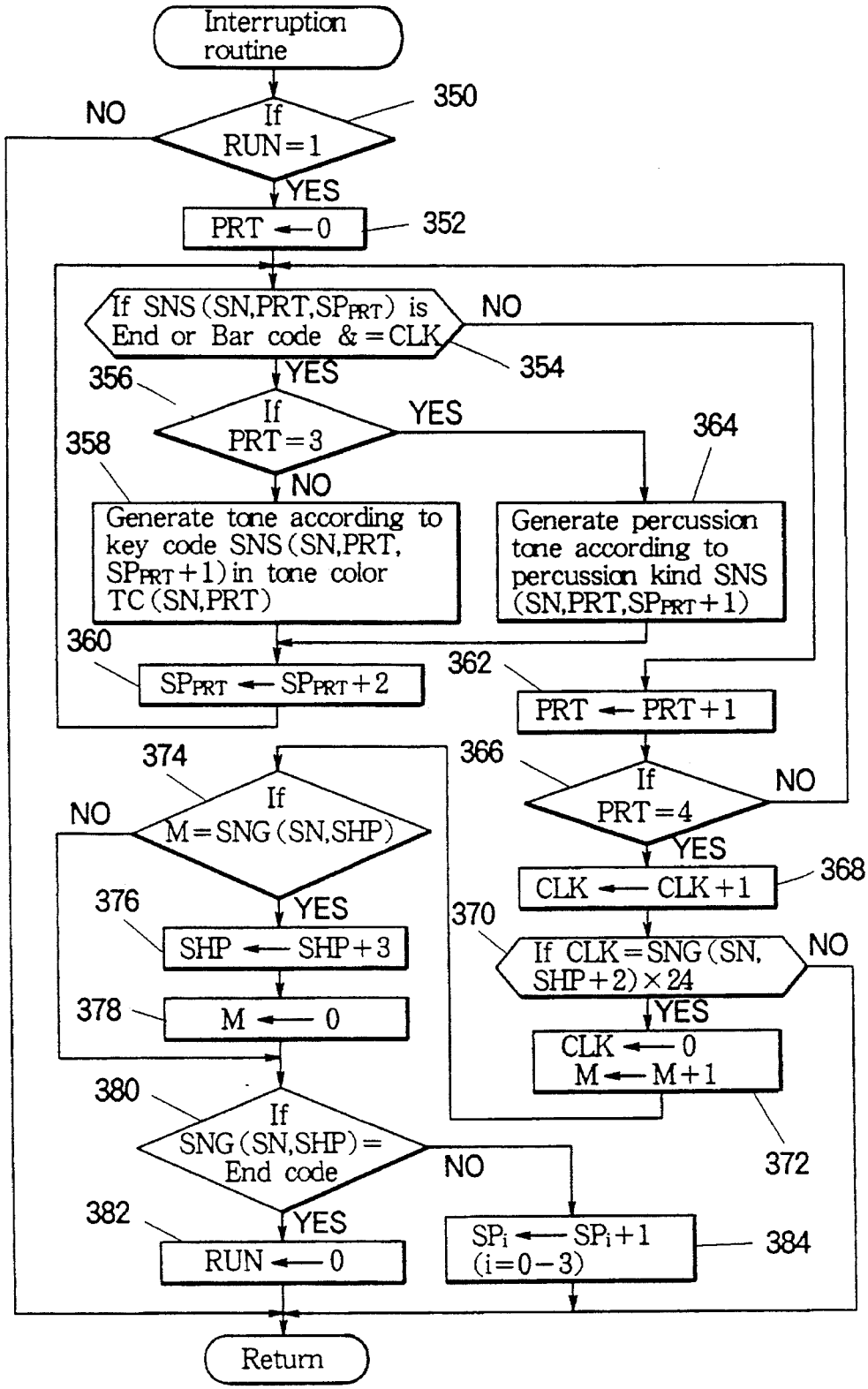
FIG. 18 is a flowchart showing an interruption routine executed in the second embodiment.

FIG. 18 shows the interruption routine, which includes various processes for the automatic performance, and which is called everywhen the timer 230 issues the interruption command signal TI. Firstly in Step 350, check is made as to if the run flag RUN is set with "1". If this check result is negative (N), the interruption routine immediately returns to the main routine of FIG. 14. On the other hand, if the check result of Step 350 is affirmative (Y), Step 352 is undertaken to set "0" into the register PRT to thereby select initially the Obbligato part. Then, Step 354 is undertaken to check as to if the data SNS(SN,PRT,$SP_{PRT}$) designated by the song number SN, the part number PRT and the corresponding address pointer $SP_{PRT}$ does not indicate either of an end code and a bar code, and coincides with a current timing specified by the counter CLK. If this check result is affirmative (Y), Step 356 is undertaken to check as to if the value of the register PRT is "3" which denotes Drum part. When Step 356 is undertaken for the first time after Step 352, the value of PRT is "0" so that the check result of Step 356 is held negative (N). In this case, the routine proceeds to Step 358.

In this step, the tone generator 226 is operated to generate a musical tone signal according to the key code data SNS(SN,PRT,$SP_{PRT}$+1) subsequent to the timing data SNS(SN, PRT,$SP_{PRT}$). In this operation, the tone color of the musical tone signal is specified by the tone color data TC(SN,PRT) designated by the selected song number SN and the selected register PRT. Next, Step 360 is undertaken to update the pointer $SP_{PRT}$ by "2", thereby returning to Step 354 to conduct the check again. If this check result is again affirmative (Y), another tone signal is generated in manner similar to the previous time. By such an operation, a plurality of musical tones can be generated at the substantially same timing.

If the check result of Step 354 is negative (N), Step 362 is undertaken to increment the register PRT by "1". Then, Step 366 is undertaken to check as to if the value of the register PRT reaches "4" which means that tone generation is completed for all the four parts at one timing. When Step 366 is carried out for the first time after Step 352, the value of the PRT is "1" so that the check result of Step 366 is held negative (N). In this case, the routine returns to Step 354 to again carry out the subsequent steps. Consequently, the tone generating process is executed successively for the Chord backing part and the Bass part. After the tone generation of the Bass part is finished, the value of the register PRT is updated to "3" in Step 362. The subsequent check result of Step 356 is turned affirmative (Y) to thereby branch to Step 364.

In this step, the tone generator 226 is operated to generate a percussive tone signal according to the percussion kind data SNS(SN,PRT,$SP_{PRT}$1). Then, the routine returns to Step 354 through Step 360 so that another concurrent percussive tone may be generated in Step 364. Thereafter, the check result of Step 354 becomes negative (N) so that the value of the PRT is incremented by "1" to reach the value "4". Consequently, the check result of Step 366 is turned affirmative (Y) to thereby proceed to Step 368. In this step, the counter CLK is incremented by "1". Then, Step 370 is undertaken to check as to if the current value of the counter CLK coincides with a certain timing value of SNG(SN, SHP+2)×24. The song composition data SNG(SN,SHP+2) designated by the song number SN and the pointer SHP+2 indicates the beat number stored in the song memory 224. Therefore, the value of SNG(SN,SHP+2)×24 represents an end timing of the current measure. If the check result of Step 370 is negative (N), the interruption routine returns to the main routine of FIG. 14.

If the check result of Step 370 is affirmative (Y), Step 372 is undertaken to reset the counter CLK to "0" as well as to increment the counter M by "1", thereby proceeding to Step 374. In this step, check is made as to if the value of the register M coincides with the measure number designated by SNG(SN,SHP). Namely, the song composition data (SN, SHP) is designated by the song number and the address pointer SHP in the song memory 224, and represents the designated measure number. If the check result of Step 374 is affirmative (Y), Step 376 is undertaken to update the pointer SHP by "3". This means that the preceding section is finished to continue to the succeeding section. Thereafter, Step 378 is undertaken to reset the counter M to "0", thereby proceeding to Step 380. In this step, check is made as to if the current song composition data SNG(SN,SHP) indicates an end of the song. If this check result is negative (N), Step 384 is undertaken to increment the respective pointers $SP_0$–$SP_3$ by "1", thereby returning to the FIG. 14 main routine. On the other hand, if the check result of Step 380 is affirmative (Y), Step 382 is undertaken to reset the run flag RUN to "0", thereby returning to the main routine of FIG. 14.

The present invention is not limited to the above described embodiment, but may include various modifications as follows:

(1) Though the last beat of the performance pattern is skipped or repeated in the disclosed embodiment, another beat such as the top beat may be skipped or repeated.

(2) The performance pattern can be freely inputted by the user.

(3) The arranged song data can be copied into an adequate record medium so that the song data can be performed at a remote place.

As described above, according to the invention, a song can be arranged in a musically natural manner even though a different meter is designated than that of the prescribed performance pattern to thereby advantageously enhance the amusement of the automatic performance of the arranged song.

Figure 19:
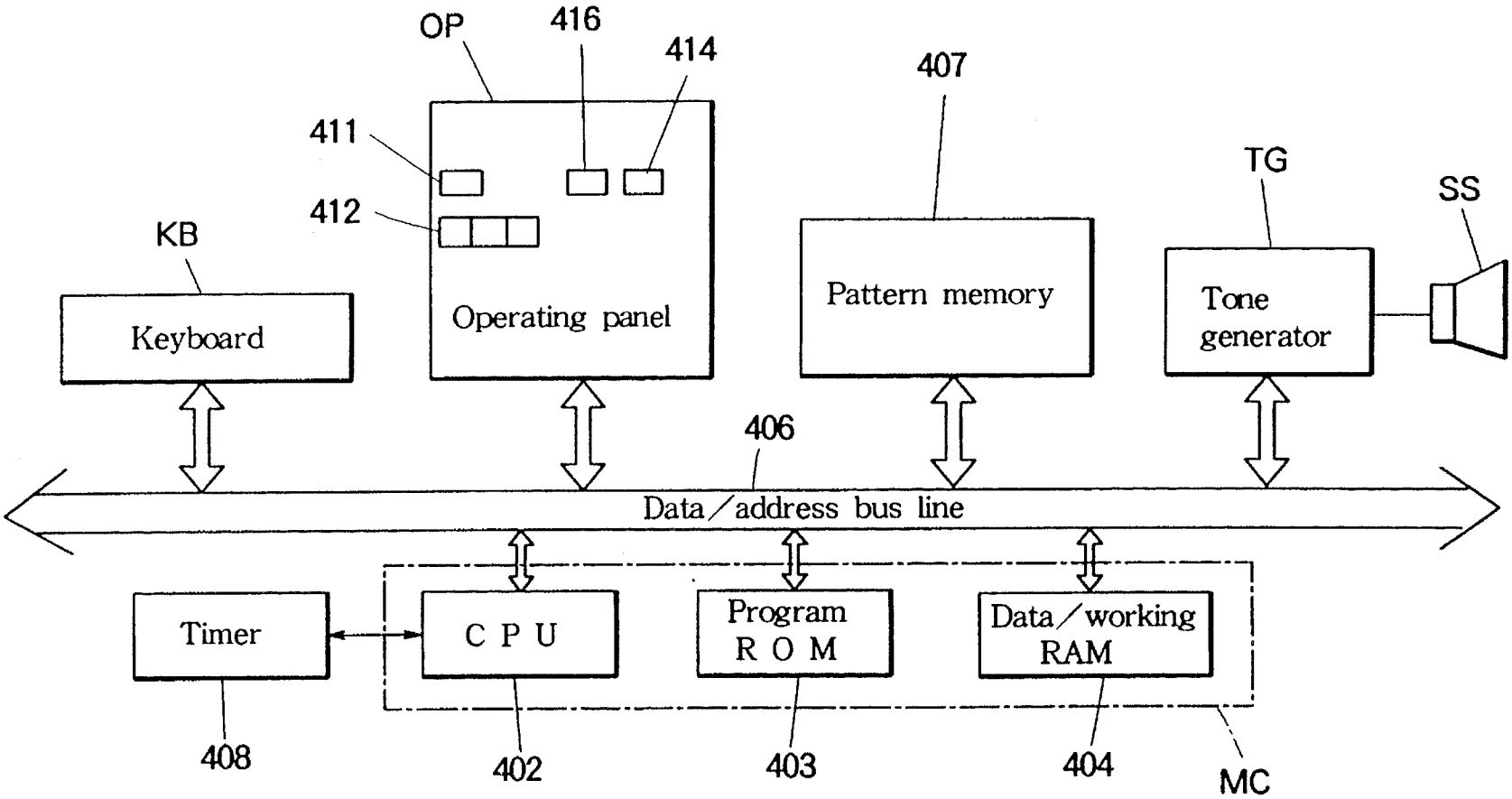
FIG. 19 is a block diagram showing an overall hardware construction of the electronic musical instrument installing a third embodiment of the inventive accompaniment apparatus.

FIG. 19 is an overall hardware construction of the electronic musical instrument provided with the third embodiment of an automatic accompaniment apparatus according to the invention. This electronic musical instrument has a microcomputer MC containing a CPU 402, a program ROM 403 and a data/working RAM 404 so as to execute various operations. The microcomputer MC is connected through a data/address bus line 406 to those of a keyboard KB, an operating panel OP, a pattern memory 407, a tone generator TG and so on. A timer 408 is set to generate 24 number of timing pulses per one beat in this embodiment. This timing pulse is fed as a tempo clock to the CPU 402 to execute a timer interruption process which will be described later with reference to FIG. 25.

This electronic musical instrument is operated under either of a regular performance mode in which a musical tone is generated in response to a key actuation on the keyboard KB, and a sequencer mode in which an automatic accompaniment is effected by retrieving part patterns recorded in the pattern memory 407 to acoustically reproduce the retrieved part patterns. In this embodiment, description will be given to the construction and operation for the sequencer mode which is directly related to the invention.

Figure 20A:
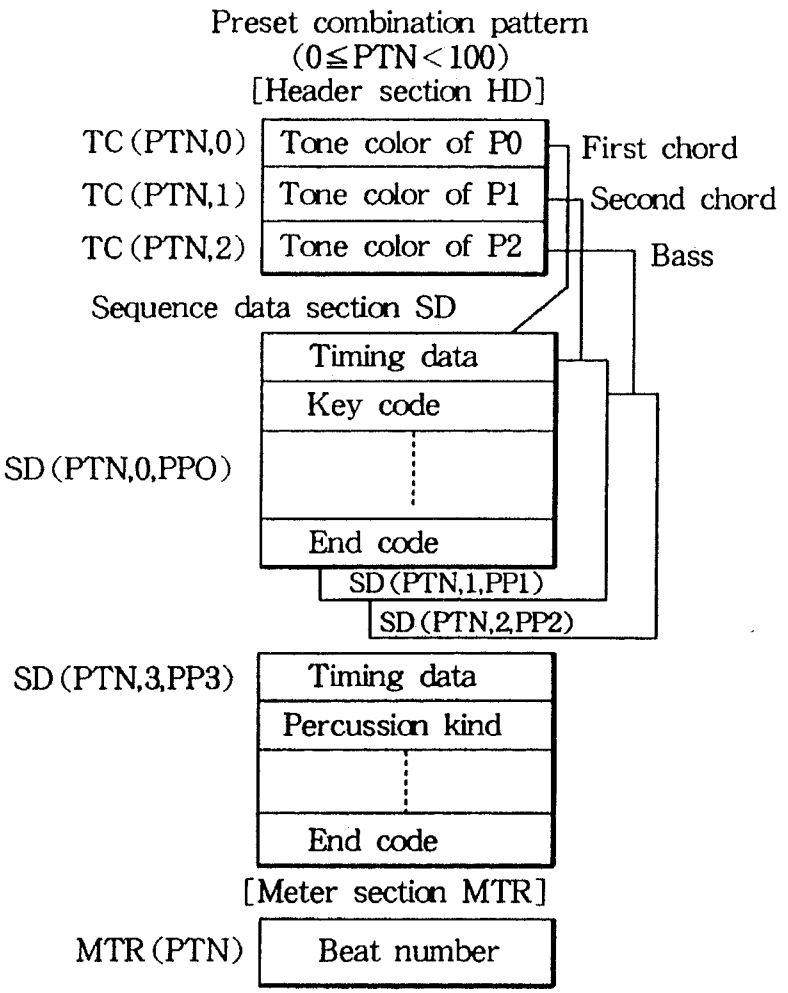
FIGS. 20A and 20B are diagrams showing data formats of a preset combination pattern and a free combination pattern.

In the sequencer mode, the pattern memory 407 is accessed to retrieve a plurality of part patterns in a parallel manner, i.e., a first chord backing part P0, a second chord backing part P1, a bass part P2 and a rhythm part P3 in this embodiment, so as to acoustically reproduce these part patterns to generate an automatic accompaniment sound. For this purpose, the pattern memory 407 is recorded with a plurality of original accompaniment patterns or preset combination patterns, each of which contains a combination of parallel part patterns and other data, arranged in a given data format as exemplified by FIG. 20A. Namely, the pattern memory 407 has a given memory area for storing, for example, one hundred number of preset combination patterns which are identified by a pattern number PTN where $0 \leqq PTN < 100$. FIG. 20A shows an example of the memory format of one preset combination pattern identified by a given preset combination pattern number PTN. The data area is divided into a header section HD, a sequence data section SD and a meter section MTR. The header section HD is stored with tone color codes TC which represent tone colors assigned to the respective accompaniment parts P0, P1 and P2 which are composed of pitched tones. An address location storing the tone color code TC of each part P0, P1 and P2 is designated by the combination pattern number PTN and the part number 0, 1, 2. In the FIG. 20A format, a notation is given such that a symbol representative of a data value is followed by a parenthesized symbol representative of an address of the data in order to indicate both of data value and address. For example, the notation TC(PTN,0) represents that the color tone code TC is stored in an address location identified by the certain preset combination pattern number PTN and the certain part number "0". Namely, the given TC represents a tone color assigned to the first chord backing part P0 corresponding to the part number "0" in the particular preset combination pattern corresponding to the pattern number PTN. The part numbers "0", "1", "2" and "3" correspond, respectively, to the first chord backing part P0, the second chord backing part P1, the bass part P2 and the rhythm part P3.

The sequence data section SD stores a set of part patterns, each of which is composed of an accompaniment sequence data containing a sequence of a tone generation timing data and a musical tone data for each of the four parts P0, P1, P2 and P3. With regard to the accompaniment parts P0, P1 and P3 composed of pitched tones, a timing data indicative of a tone generating timing or note-on timing and a following key code data indicative of a pitch of the tone to be generated are recorded in sequential addresses corresponding to an accompaniment tone sequence. In this embodiment, the key code is determined according to a given standard chord, e.g., C Major. With regard to the rhythm part P3, a timing data and an associated percussion kind are recorded in sequential addresses corresponding to the accompaniment tone sequence. The percussion kind denotes a kind of a percussion instrument to be sounded at the designated timing. An end code is written at the last end of each part pattern. As will be described later, under the sequencer mode of the present electronic musical instrument, when these pitched parts of first chord backing, second chord backing and bass are reproduced, the involved initial key codes are converted according to a given chord which is inputted by the player through the keyboard KB on real time basis or which is provisionally recorded after the player's operation, thereby generating tuned sounds of the chord backing and bass. Address pointers PP0, PP1, PP2 and PP3 are utilized to retrieve or read out the part pattern data from the respective parts P0, P1, P2 and P3.

The sequence data or the part pattern data retrieved from the sequence data section SD is addressed in terms of the combination pattern number PTN, the part number (0, 1, 2 or 3) and the corresponding reading pointer (PP0, PP1, PP2 or PP3). For example, one sequence data SD(PTN,0,PP0) is retrieved from a particular address location designated by a pointer value of the pointer PP0 on the first chord backing part P0 of the certain original combination pattern PTN. The same is true with respect to the other parts of the sequence data SD(PTN,1,PP1), SD(PTN,2,PP2) and SD(PTN,3,PP3). The pattern data is read out from the respective accompaniment parts P0–P3 in parallel manner, i.e., practically time-sharing manner so as to effect concurrent sounding of all the accompaniment parts to thereby provide an automatic accompaniment of the designated combination pattern. In this embodiment, each part pattern of P0–P3 has a pattern length of one measure for the simplicity of the description. Namely, the same pattern data is repeatedly reproduced every measure. Alternatively, the part pattern may have a length of two or four measures if desired.

The respective part patterns of P0, P1, P2 and P3 have a common meter within one preset combination pattern. The meter section MTR of the aforementioned data format stores a common meter data of the preset combination pattern in the form of a beat number within one measure, such as "3" in the case of ¾ meter and "4" in the case of 4/4 meter. This meter section MTR is addressed by a corresponding combination pattern number PTN, as represented by MTR(PTN). While the respective parts have a common meter within each preset combination pattern, different preset combination patterns may have different meters. For example, one preset combination pattern has ¾ meter, whereas another preset combination pattern has 4/4 meter.

In this embodiment, the user can freely collect the respective part patterns from different preset combination patterns so as to newly form a free combination pattern which is different from any of the one hundred styles of the preset combination patterns. Namely, the user can select a set of accompaniment part patterns of P0–P3 separately and independently of each other from desired ones of the preset combination patterns regardless of the meter to create a free combination pattern, which is registered in a free combination pattern memory area within the pattern memory 407. Each free combination pattern is designated by a pattern number PTN over one hundred (i.e., $PTN \geqq 100$).

Figure 20B:
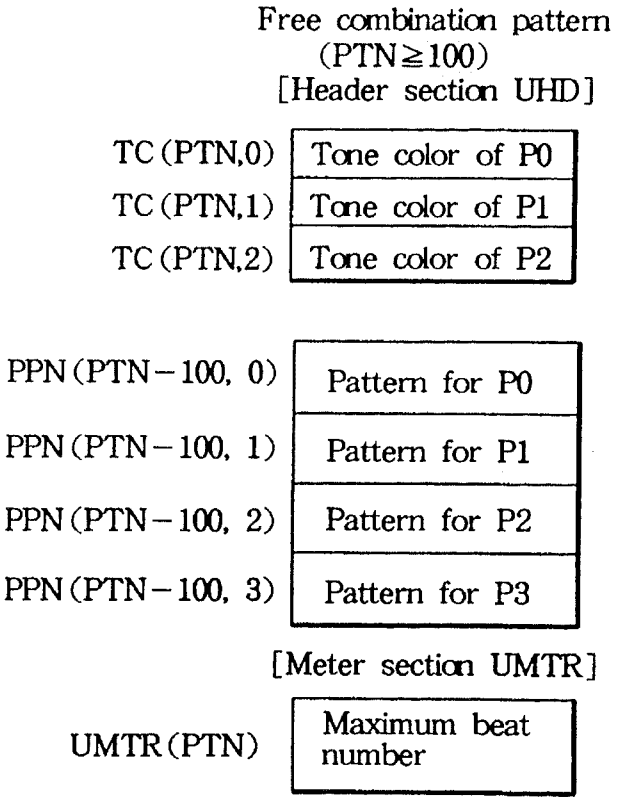

FIG. 20B shows a data format of the free combination pattern registered in the pattern memory 407. The data area of one free combination pattern contains a header section UHD, part pattern designating section PPN and a meter section UMTR. In a manner similar to the preset combination pattern, the header section UHD stores tone color codes TC assigned to the respective accompaniment parts P0, P1 and P2. The tone color code TC is addressed by those of a given pattern number PTN over "100", and a part number (0, 1 or 2).

The part pattern designating section PPN is provided in place of the sequence data section SD for the free combination pattern. The part pattern designating section PPN stores the numbers PTNs of the preset combination patterns freely selected and set by the user for respective ones of the parallel parts P0–P3. Namely, each part pattern of the free combination is specified indirectly by the corresponding preset combination pattern number PTN. The address locations of the part pattern designating section PPN, which store the selected preset combination pattern numbers for the respective parts P0–P3, are identified by the free combination pattern number PTN and the part number (0, 1, 2 or 3). Though the free combination pattern number PTN takes a value over one hundred, an offset value "PTN–100" is utilized for the address location purpose within the part pattern designating section PPN so as to save a bit number of the address data, because the use of the offset value "PTN–100" is limited within the part pattern designating section PPN. For example, PPN (PTN–100, 0) indicates a certain preset combination pattern number stored in the address location designated by the offset value "PTN–100" and the part number "0". Further, a sequence data of the part "0" contained in the certain preset combination pattern is utilized as the sequence data of the part "0" of the present free combination pattern PTN.

Further in this embodiment, the header section UHD registers the tone color code data identical to those assigned to the preset combination patterns which are selected and set in the part pattern designating section PPN. Hereinafter, the selected and set one of the preset combination pattern is denoted by PRPTN. For example, if the user selects a number "3" of the preset combination pattern (PRPTN=3) for the first chord backing part P0 of a certain free combination pattern PTN, the tone color code TC stored in the header section HD for the first chord backing part P0 of the preset combination pattern (PRPTN=3) is registered as it is in the header section UHD of the free combination pattern PTN for representing the tone color TC of the first chord backing part P0. The header section UHD registers the respective tone color codes TC for the parts P0–P2 except for the rhythm part P3 which has a percussion kind of data in the part pattern, and therefore does not need a tone color code TC.

Figure 21:
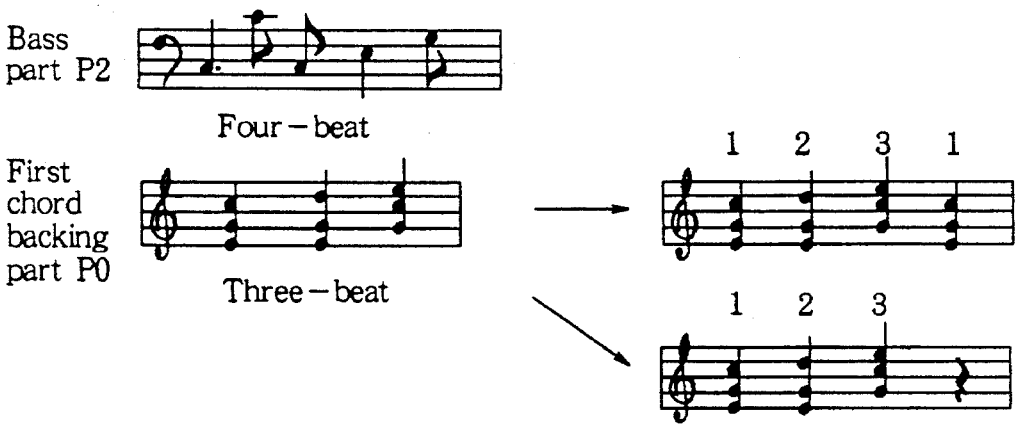
FIG. 21 is a score diagram schematically illustrating a beat adjustment process in the third embodiment.

Since the respective accompaniment parts P0–P3 of one free combination pattern are freely selected from different preset combination patterns, the respective part patterns may be inconsistent with each other in terms of the meter. In view of this, the meter section UMTR of the free combination pattern registers a standard meter which is the longest meter having the maximum beat number among the freely selected set of the four parallel parts. Further, in a timer interruption process, which will be described later in detail, for reading out the set of four parts in a parallel manner, an adjustment is made for a shorter part so as to conform with the standard meter registered in the UMTR. For example as shown in FIG. 21, when one measure of the shorter part pattern is finished, the same part pattern is again read out from the top to add one or more beat so as to complete the standard meter. Namely as exemplified by FIG. 21, provided that the bass part P2 has a selected part pattern of the maximum four-beat (the standard beat number) and the first chord backing part P0 has another selected part pattern of shorter three-beat, the first chord backing part P0 is reproduced such that after the third beat is finished the first beat is additionally read out to reproduce the first chord backing part P0 in the manner of the four-beat pattern. Alternatively, a rest note may be added in place of a repeated first note. Further, if the shorter part has two-beat deficiency, the first and second beats may be additionally read out to satisfy the standard meter.

Referring back to FIG. 19, the keyboard KB is manipulated by the user to input a chord data effective to determine a pitch of the automatic accompaniment under the sequencer mode. The keyboard KB operates in response to a key touch to produce a key-on event signal as well as a key code associated with the touched key. The operating panel OP contains various manual pieces such as a start/stop switch 411 for controlling start and stop of the automatic accompaniment, and a combination pattern selecting switch 412 for selecting a desired number PTN of the preset and free combination patterns. The start/stop switch 411 is a toggle switch operated such that the start and stop states are switched alternately everytime the toggle switch is actuated. The operating panel OP further includes an editing switch 414 utilized for registering a free combination pattern, and a part designating switch 416 for designating each part during the registration of the free combination pattern. Further in this embodiment, the combination pattern selecting switch 412 is commonly utilized to select and set the respective part pattern of the free combination pattern from the different preset combination patterns when the editing switch 414 is turned to establish the free combination setting pattern mode, thereby saving an actual number of switch pieces. The operating panel OP outputs corresponding signals in response to the actuation of the involved manual pieces. The combination pattern selecting switch 412 and the accompaniment part designating switch 416 may be composed of a common ten-key. Thus, the operating panel constitutes an editor for inputting a prescription data shown in FIG. 20B to register a free combination pattern.

When the combination pattern selecting switch 412 is actuated to select a desired one of the preset and free combination patterns to start the automatic accompaniment, the CPU 402 operates to retrieve the pattern data from the respective parts of the selected combination pattern. In this case, when the free combination pattern is selected, the CPU 402 controls the data reading operation to achieve the aforementioned meter adjustment among the parallel parts of the different meters. The thus retrieved pattern data is fed to the tone generator TG. The tone generator TG receives the various data fed from the data/address bus line 406 so as to generate musical tone signals through a multiplicity of channels. These musical tone signals are subjected to D/A conversion, and thereafter are acoustically reproduced by means of a sound system SS.

Next, description is given of the various processings executed by the microcomputer MC in conjunction with flowcharts shown in FIGS. 22–26. Firstly, major flags and buffer registers utilized in the processings are listed below, which are provided in the data/working RAM 404.

ROOT: a chord root note register for storing a root note of a chord designated by the player during the course of the automatic accompaniment.

TYPE: a chord type register for storing a type of a chord (such as Major, Minor) designated by the player.

PTN: a selected combination pattern number register for storing a combination pattern number PTN selected by means of the combination pattern selecting switch 412.

RUN: a run flag which holds "1" when the automatic accompaniment is running by the operation of the start/stop switch 411, and holds "0" when the automatic accompaniment is suspended.

CLK: a tempo clock counter for counting a tempo clock outputted from the timer 408 to indicate a progression point of the accompaniment pattern within one measure. This tempo clock counter is reset when the counted value reaches a maximum which is determined according to the beat number set in either of the meter sections MTR or UMTR of the selected combination pattern. For example, in case of the three-beat pattern, the tempo clock counter starts the count from "0" to "72" (3×24) and is then reset to "0".

i: A variable register for indicating one of the part numbers "0"–"3".

MTRR: A beat number register for registering a content of the meter section MTR or UMTR of the selected preset or free combination pattern in the automatic accompaniment. The beat number register registers a common beat number when the preset combination pattern is selected, and registers a maximum beat number (i.e., the standard beat number) when the free combination pattern is selected.

CPTN: A free combination pattern number register for registering a desired free combination pattern number PTN≧ 100 when editing the free combination pattern.

PRPTN: A preset combination pattern number register for registering a desired preset combination number which is selected to determine a part pattern of a respective accompaniment part of a free combination pattern.

PT: A part number register for registering an accompaniment part number ("0"–"3") inputted by means of the accompaniment part designating switch 416 in the setting or editing of the free combination pattern.

M: A beat number buffer utilized for comparing beat numbers of the respective parts of the free combination pattern so as to detect the maximum beat number.

Figure 22:
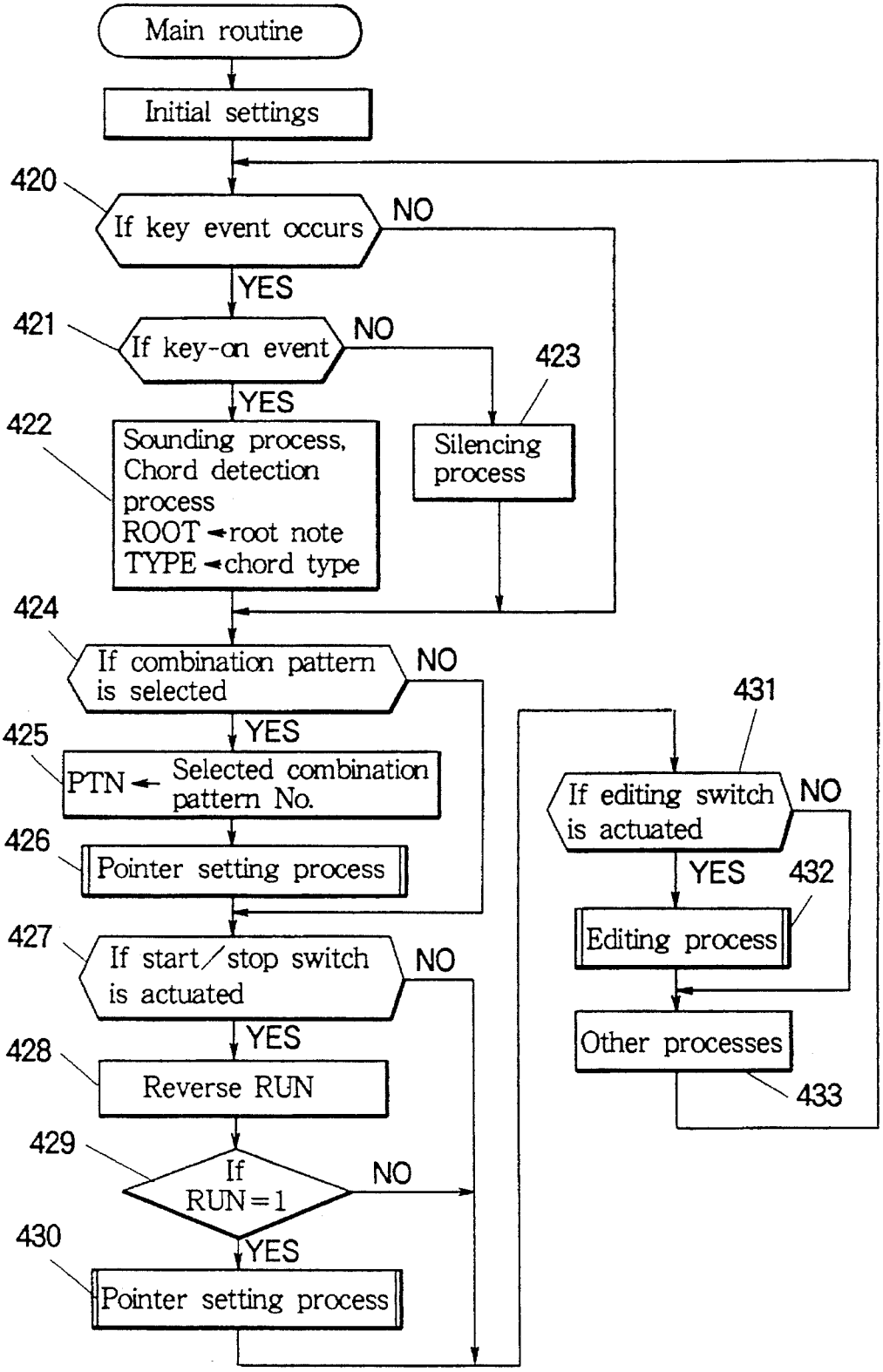
FIG. 22 is a flowchart showing a main routine executed in the third embodiment.

FIG. 22 shows a main routine in which various processings are executed according to associated events after initial settings. Firstly, when a new key event is detected on the keyboard KB at Step 420, check is made as to if the detected event is a key-on event at Step 421. In case of the key-on event, an instant tone generating process or a chord detection process is carried out in Step 422. In the chord detection process, when a chord input is performed on the keyboard KB, a root note and a type of the inputted chord are stored into the root note register ROOT and the chord type register TYPE, respectively. If the check result of Step 421 is NO, a key-off event is accordingly taken place so that a silencing process is carried out in Step 423. If the check result of Step 420 is NO, Steps 421–423 are skipped.

Check is made in Step 424 as to if the combination pattern selecting switch 412 is actuated to select any one of the preset and free combination patterns. If YES, the combination pattern number designated by the switch 412 is registered in the combination pattern number register PTN in Step 425. Then, next Step 426 is undertaken to effect a pointer setting process in which reading pointers PP0–PP3 are set to top addresses of the respective parts P0–P3 so as to concurrently read out all the part patterns of the selected combination pattern. This pointer setting process will be described in detail with reference to FIG. 24. If the check result of Step 424 is NO, Steps 425 and 426 are skipped.

Check is made in Step 427 as to if the start/stop switch 411 is actuated. If YES, the run flag RUN is reversed in Step 428 such as "0" to "1" or "1" to "0". Then, Step 429 is undertaken to check as to if the reversed run flag indicates "1". The check result of Step 429 is YES when the start/stop switch 411 is turned on during other than the running period of the automatic accompaniment. In such a case, Step 430 is undertaken to execute the pointer setting process in the manner of Step 426 so as to set the reading pointers PP0–PP3 to the top addresses of the respective parts P0–P3. The pointer setting process of Step 426 is executed when a new combination pattern is selected during the course of the automatic accompaniment. If the check result of Step 427 is NO, Steps 428–430 are skipped. Further, if the check result of Step 429 is NO, Step 430 is also skipped since the automatic accompaniment is not called.

Further, check is made in Step 431 as to if the editing switch 414 is turned on. If this check result shows YES, Step 432 is undertaken to execute an editing process so as to arrange a free combination pattern. The editing process will be described later in detail with reference to FIG. 23. If the editing switch 414 is not turned on, the editing process of Step 432 is skipped to proceed to Step 433, in which other necessary processings are executed, thereafter returning to Step 420 to repeatedly carry out Step 420 and subsequent steps.

Figure 23:
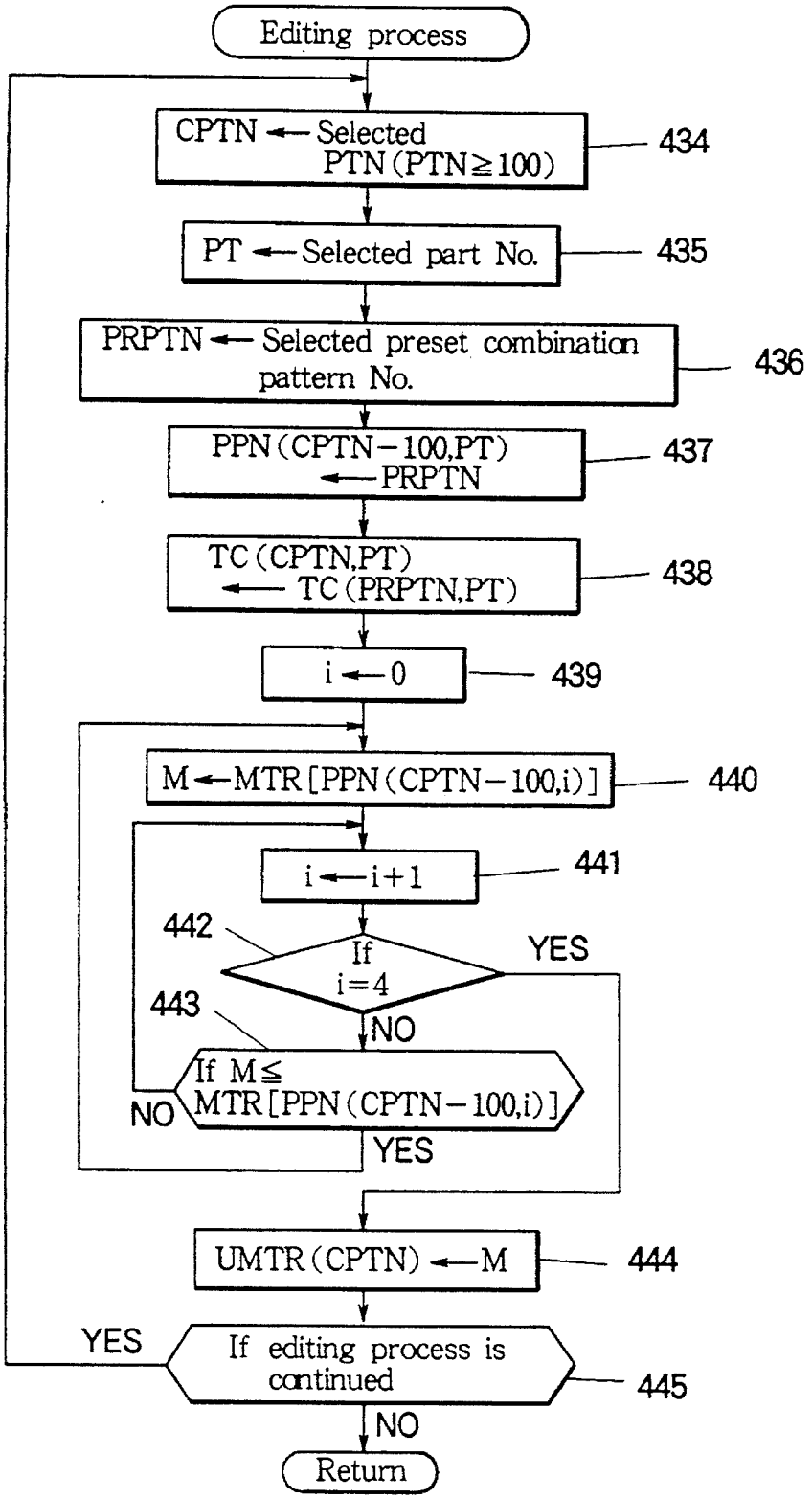
FIG. 23 is a detailed flowchart showing an editing process of the FIG. 22 main routine.

When the editing switch 414 is turned on, the free combination pattern setting mode is called so that the editing process routine is executed as shown in FIG. 23 to thereby newly register a desired free combination pattern. Firstly in Step 434, an inputted number PTN of a desired free combination pattern is loaded into the free combination pattern number register CPTN where PTN≧100. The inputting of the desired PTN is carried out by means of the combination pattern selecting switch 412. For example, if the inputted combination pattern number PTN is not less than "100", it is judged that the free combination pattern number is inputted and set. This judgement may be carried out in Step 434. Alternatively, check may be made in a preceding step as to if the content of the combination pattern number register PTN is not less than "100", and if YES, the content is transferred to the free combination pattern number register CPTN.

In a next Step 435, an inputted part number ("0", "1", "2" or "3") is loaded into the part number register PT. The inputting of a desired part number is effected by means of the accompaniment part designating switch 416. In a next Step 436, an inputted number PTN of a preset combination pattern (PTN<100) is loaded into the preset combination pattern number register PRPTN, which indirectly identifies a certain part pattern utilized as the designated part of the free combination pattern. The inputting of a desired preset combination pattern number is effected, for example, by means of the combination pattern selecting switch 412. Namely, if the inputted number PTN is less than "100", it is judged that a desired preset combination pattern number is inputted and set. Such a judgement may be conducted in Step 436. Alternatively, check may be made in a preceding step as to if the content of the combination pattern number register PTN is less than "100", and if YES, the content is transferred to the preset combination pattern number register PRPTN.

In a next Step 437, the preset combination pattern number stored in the register PRPTN is written into the part pattern designating section PPN(CPTN–100,PT) of the free combination pattern memory area, which is identified by the contents of the registers CPTN and PT. For example, provided that the free combination pattern number register CPTN indicates "112", the part number register indicates "0" representative of the first chord backing part P0, and the preset combination pattern number register PRPTN indicates "50", the preset combination pattern number "50" is written into the part pattern designating section PPN (12, 0) identified by the pattern number "12" (=112–100) and the part number "0". In a next Step 438, a tone color code TC (PRPTN,PT) is retrieved from the header section HD of the preset combination pattern memory area, which is specified by PRPTN and PT, and the retrieved tone color code TC is transferred to an address location TC(CPTN,PT) of the header section UHD of the free combination pattern memory area, which is identified by the contents of the registers CPTN and PT. For example, provided that a concerned accompaniment part is the first chord backing part P0 and a piano sound is assigned to the concerned part of the selected preset combination pattern, a tone color code representative of the piano sound is written into the address location TC(CPTN,PT) of the header UHD of the free combination memory area. By the sequence of Steps 434–438, the setting is achieved for one selected accompaniment part.

In a next sequence of Steps 439–443, processing is carried out to detect a maximum beat number among accompaniment parts P0–P3 involved in the free combination pattern, which are individually and indirectly designated in terms of the different selected preset combination patterns. Firstly, in Step 439, the variable register i is reset to "0". Then, in Step 440, a beat number data is retrieved from the meter section MTR[PPN(CPTN–100, i)] of the preset combination pattern which is specified by the pattern number stored in the part pattern designating section PPN(CPTN–100, i) which is identified by the number CPTN of the currently processed free combination pattern and the part number i (initially, i="0") indicated by the register i. Then, the retrieved beat number data is temporarily memorized in the beat number buffer M. Thereafter, the register i is incremented in Step 441, and check is made as to if the variable i reaches "4" in Step 442. If NO, subsequent Step 443 is undertaken to similarly retrieve the beat number data MTR[PPN(CPTN–100, i)] from the meter section of the corresponding preset combination pattern with respect to the incremented variable i, and the retrieved beat number data is compared with the content of the beat number buffer M so as to check if M≦(MTR[PPN(CPTN–100, i)] is held. If the check result of Step 443 is NO, the above sequence of Steps 441–443 is repeated to update the part number i and to carry out the above mentioned comparison. On the other hand, if the check result of Step 443 is YES, the processing returns to Step 440 so that the beat number data MTR[PPN(CPTN–100, i)] of the updated part number i is loaded into the beat number buffer M. The loop of Steps 440–443 is repeated until the variable i reaches "4". In such a manner, the beat numbers of all the parallel parts P0–P3 are successively compared with each other so that the finally stored value of the beat number buffer M indicates the maximum beat number among the set of four parts. Accordingly, if the check result of Step 442 turns to YES, Step 444 is undertaken to write the value of the beat number buffer M into the meter section UMTR(CPTN) of the currently treated free combination pattern to define the standard meter thereof.

After Step 444 is finished, Step 445 is undertaken to check as to if a next setting should be carried out. If YES, the processing returns to initial Step 434 to repeat the above noted editing routine. If NO, the processing returns to the main routine. The judgement as to request for another setting can be made in various manners. For example, check may be made as to if the editing switch 414 is again turned on. Alternatively, the content of the part number register PT may be successively updated to execute the editing process for all of the parts. Otherwise, check may be made as to if an additional editing confirmation switch is turned on. If not turned on, the editing process routine is repeated. If turned on, the process returns to the main routine.

Figure 24:
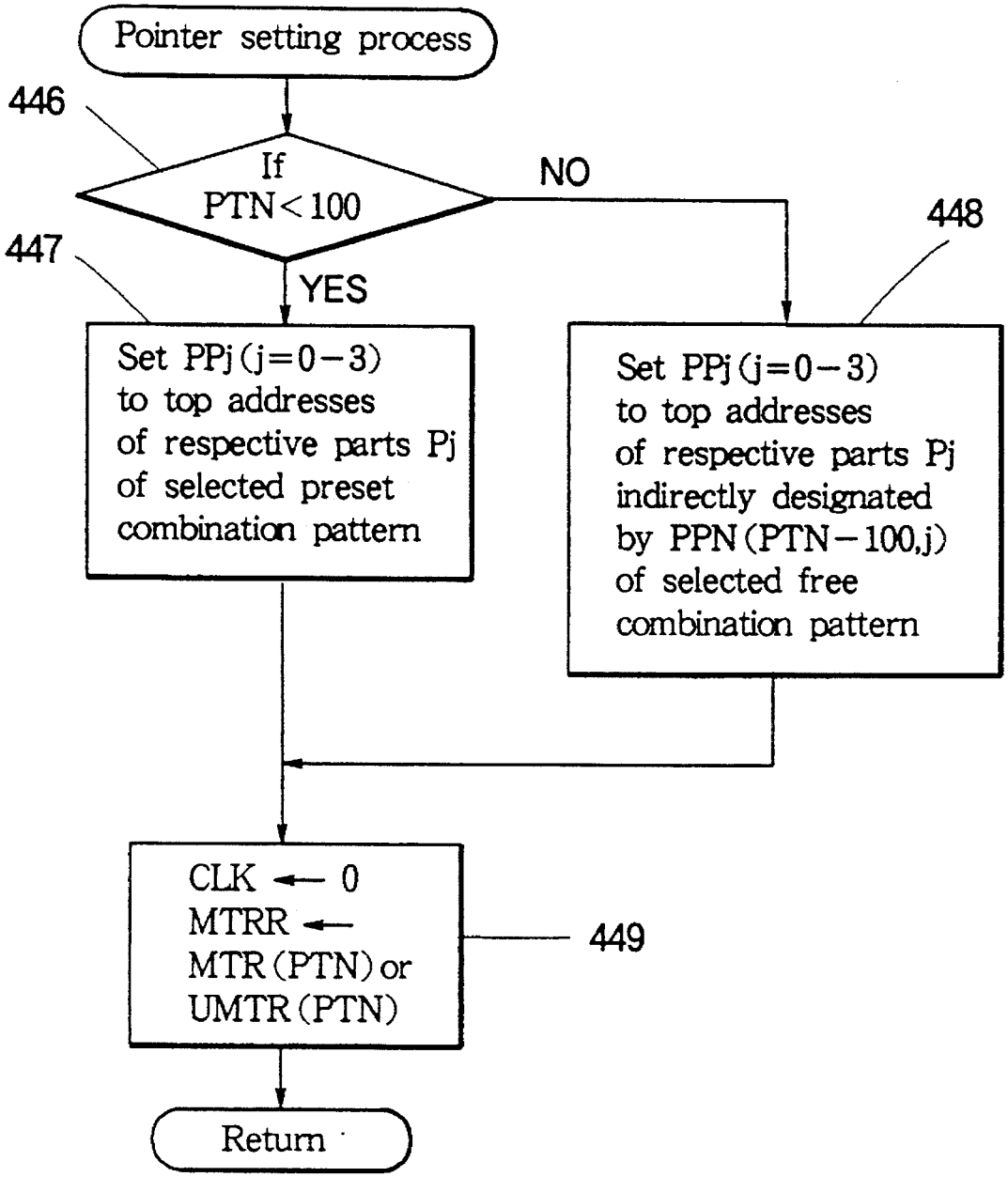
FIG. 24 is a detailed flowchart showing a pointer setting process of the FIG. 22 main routine.

Referring to FIG. 24, the pointer setting process is carried out such that the respective pointers PP0–PP3 are set to top addresses of corresponding parts of the selected preset combination patterns to start reading of the accompaniment part patterns. Firstly in Step 446, check is made as to if the combination pattern number stored in the register PTN is less than "100", i.e., as to if a preset combination pattern is selected. If YES, Step 447 is undertaken to set each pointer PPj (j=0–3) at the top address of the corresponding accompaniment part Pj (i=0–3). Then, Step 449 is undertaken to set "0" into the clock counter CLK which indicates an accompaniment progression point within one measure, and the beat number registered in the meter section MTR of the concerned preset combination pattern is written into the beat number register MTRR. Thereafter, the processing returns to the main routine.

On the other hand, when a free combination pattern is selected by means of the combination pattern selecting switch 412, the check result of Step 446 is NO since the combination pattern number stored in the register PTN is not less than "100". In this case, Step 448 is undertaken to set each reading pointer PPj at the top address of the respective part Pj which is indirectly designated by the part pattern designating section PPN(PTN–100, j) of the selected free combination pattern. Thereafter, the processing advances to Step 449 where the beat number registered in the meter section UMTR of the selected free combination pattern is written into the beat number register MTRR, thereby returning to the main routine.

Figure 25:
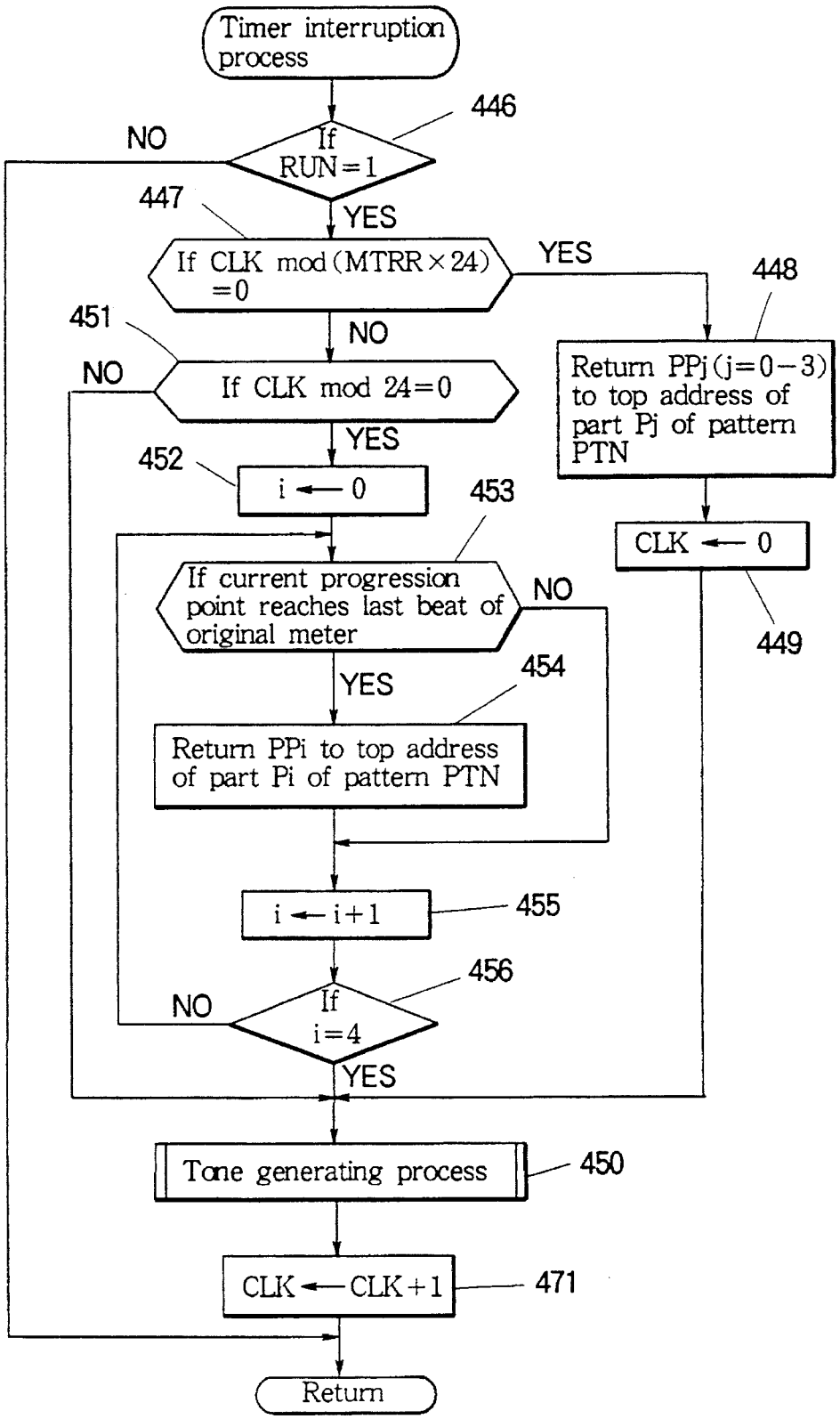
FIG. 25 is a flowchart showing a timer interruption process called in the FIG. 22 main routine.

Referring to FIG. 25, after the pointer setting process, the timer interruption process is periodically executed to actually read out the selected combination pattern. In this timer interruption process, whenever the timer 408 produces a tempo clock pulse at the rate of 24 times per one beat, the selected preset or free combination pattern is read out to continuously reproduce the accompaniment sound. Firstly in Step 446, check is made as to if the run flag RUN indicates "1", i.e., as to if the automatic accompaniment is running. If the automatic accompaniment is not running, the processing immediately returns to the main routine without executing following Steps. If the automatic accompaniment is running, this check result is YES so that subsequent check is made in Step 447 as to if the tempo clock counter CLK operating by the given modulo number "MTRR×24" has a value "0" as the current count value which is hereafter denoted CLKmod(MTRR×24). The value stored in the register MTRR indicates the common or standard beat number within one measure and the number "24" denotes a clock number per one beat, hence the modulo number MTRR× 24 of the tempo clock counter CLK corresponds to a total number of tempo clocks within one measure. Thus, the condition CLKmod(MTRR×24)=0 means that the current accompaniment progression point is at the top of the measure. Therefore, in Step 447, the check is made as to if the current progression point is at the top of the measure.

If the check result of Step 447 is YES, Step 448 is undertaken to move each reading pointer PPj (j=0–3) to the top address of the corresponding part Pj involved in the presently performed combination pattern identified by PTN. Namely, when the pattern of one measure length is completed, each reading pointer PPj is returned to the top of the respective part Pj to thereby repeatedly reproduce the selected accompaniment pattern. After Step 448, the tempo clock counter CLK is reset to "0" in Step 449. Thereafter, Step 450 is undertaken to execute a tone generating process, the details of which will be described later in conjunction with FIG. 26.

On the other hand, when the check result of Step 447 shows that the current value of the tempo clock counter CLK having the modulo MTRR×24 is not "0", which means that the current accompaniment progression point is not at the top of the measure, subsequent check is made in Step 451 as to if another tempo clock counter CLK operating at a modulo number "24" has a current value (hereinafter, denoted by CLKmod24) identical to "0". Namely, check is made as to if the current accompaniment progression point is at a top of a given beat or a note. If not, the processing jumps to Step 450 to execute the tone generating process.

On the other hand, if the current accompaniment progression point is at the top of a given beat, the check result of Step 451 turns to YES. In such a case, subsequent Steps 452–456 are undertaken to carry out a beat adjustment process such that a shorter part pattern is read out such as to adjust for a deficient beat based on the standard beat number stored in the register MTRR to thereby equalize all the beats of the respective part patterns. Firstly, in Step 452, the variable register i is set with "0" to designate the first part, i.e., part P0. In a next Step 453, check is made as to if the accompaniment pattern of the designated part (initially, part P0) reaches the last beat of the original meter which is indicated by the meter section MTR of a preset combination pattern from which the designated part of the free combination pattern is collected. The order of the beat on the current accompaniment progression point is specified by the calculation CLK/24+1. For example, at the top point of the first beat where CLK=0, the calculation result is given 0/24+1=1 which indicates the first order. At the top point of the second beat where CLK=24, the calculated result is given 24/24+1=2 which indicates the second order. On the other hand, the original beat number of the designated part i of the selected free combination pattern number PTN is specified by the meter section MTR of the preset combination pattern, a number of which is stored in the part pattern designating section PPN (PTN–100, i) of the selected free combination pattern. Stated otherwise, the original beat number of the designated part i is specified by MTR[PPN(PTN–100, i)]. Thus, in Step 453, the computed result CLK/24+1 is compared to MTR[PPN(PTN–100, i)] to determine if the current progression point reaches the last beat of the original meter. If the check result of Step 453 is YES, this means that the original beat number of the designated part is smaller than the standard beat number. The beats of all the parts of the free combination are adjusted to the maximum beat number or the standard beat number stored in the register MTRR by preceding Step 447. Since Step 453 is conducted after the negative judgement by Step 447, the affirmative judgement of Step 453 proves that the original beat number of the designated part is smaller than the standard beat number.

Thus, if the check result of Step 453 is YES, a subsequent Step 454 is undertaken to add one or more beat which is retrieved from its own accompaniment pattern. In this embodiment, Step 454 is carried out such that the reading pointer returns to the top of the part pattern to read out a needed number of beats. Namely in Step 454, the reading pointer PPi is set to the top address of the designated part Pi which is specified by the selected combination pattern number PTN and the content of the variable register i.

In a next Step 455, the variable register i is updated by "1" to designate a next part. On the other hand, if the check result of Step 453 i remained NO, the current progression point does not yet reach the last beat so that the processing jumps to Step 455 without carrying out Step 454 because the adjustive reading is not yet needed. Thereafter, check is made in Step 456 as to if the content of the variable register i reaches the end value "4". If this check result is held NO, the processing returns to Step 453 to repeat the subsequent steps for the next part. By such an operation, in case that the free combination pattern is selected for the automatic accompaniment, the reading pointer PPi is returned to the top address of the part pattern immediately after the last beat thereof is finished if the part pattern has the original beat number deficient to the standard beat number of the free combination pattern. When the above adjustive processing is completed for all the parts P0–P3, the check result of Step 456 turns to YES to thereby proceed to Step 450 to effect the tone generating process. Thereafter, the tempo clock counter CLK is incremented by "1" in Step 471 to finish the timer interruption routine. By such an operation, if the original beat number of the respective part of the free combination pattern is smaller than the maximum or standard beat number, the reading pointer PPi is set to the top address of the respective part to return to the first beat so as to supplement a deficient beat by extended or additional pattern reading. As a result, the adjustment to the standard meter is effected as illustratively shown in FIG. 21. On the other hand, when a preset combination pattern is selected for the automatic accompaniment, all the parts have the same beat number so that all the parts concurrently reach the last beat. In this case, the check result of Step 447 turns to YES without proceeding to Step 453. Consequently, the process of Steps 451–456 is never called for the preset combination pattern.

Figure 26:
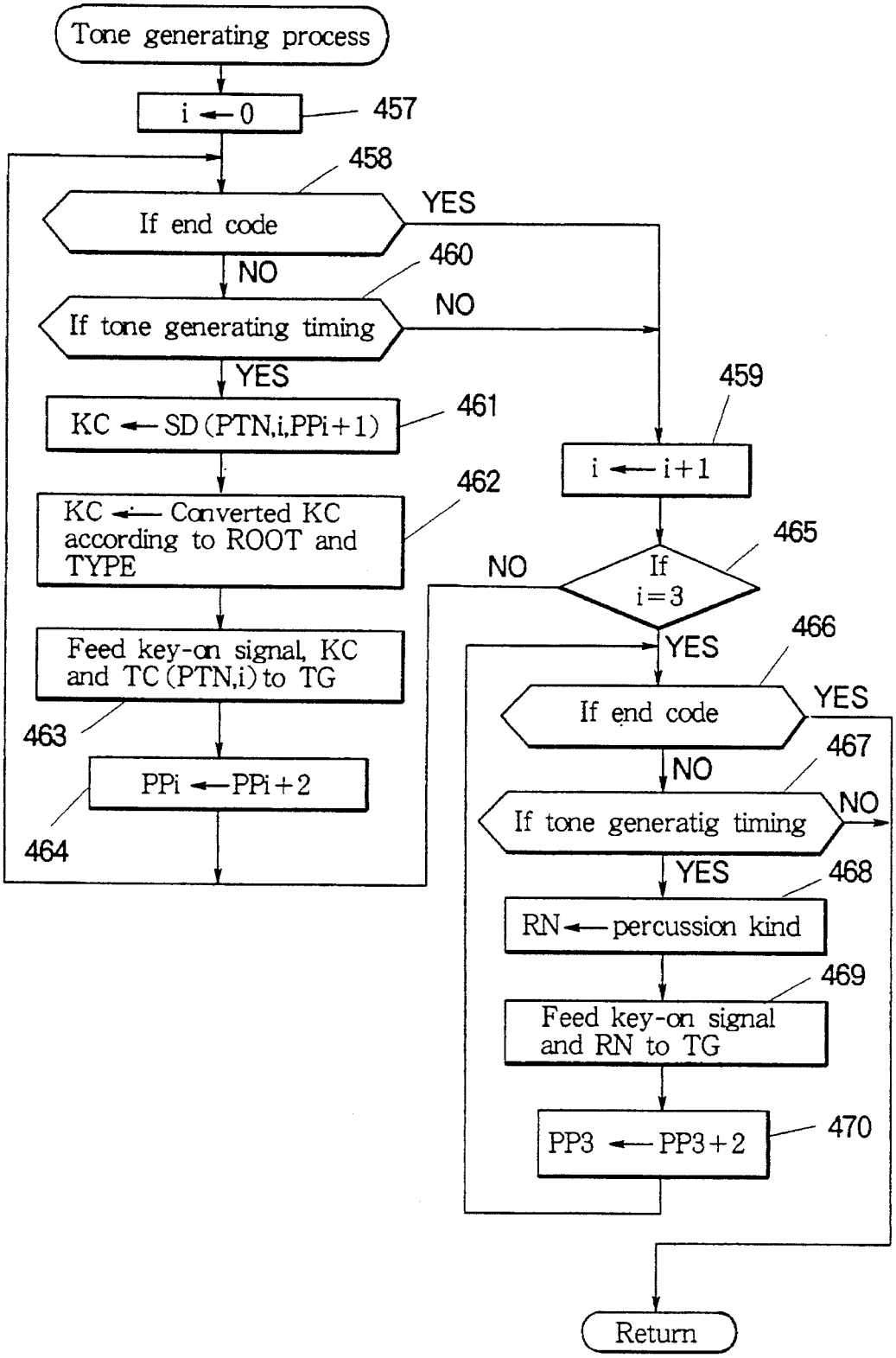
FIG. 26 is a detailed flowchart showing a tone generating process executed in the FIG. 25 interruption routine.

Referring to FIG. 26, the tone generating process is carried out such that the retrieved part pattern is acoustically reproduced to generate accompaniment tones. Firstly, the variable register i is set with "0" in Step 457. Subsequent Steps 458–464 are conducted to carry out the tone generating process for an accompaniment part i (initially, the first chord backing part P0) designated by the variable register i. Step 458 is undertaken to address the sequence data SD(PTN, i, PPi) according to the pattern number PTN, the part number i and the associated reading pointer PPi. Further, check is made as to if the addressed sequence data SD indicates an end code. If YES, Step 459 is undertaken to increment the variable register i by "1". Then, check is made in Step 465 as to if i=3 is satisfied. If NO, the processing returns to Step 458 to carry out the same process for a next part.

On the other hand, if Step 458 proves that the sequence data SD does not indicate the end code, the addressed sequence data SD (PTN, i, PPi) represents a timing data, because the timing data proceeds to the key code data as shown in the data format of FIG. 20A. In next Step 460, check is made as to if the timing data of the addressed sequence data SD(PTN, i, PPi) coincides with the current count value of the tempo clock counter CLK, i.e., as to if the current accompaniment progression point reaches a tone generating moment determined by the read timing data. If NO, processing branches to Step 459 to increment the variable register i by "1", thereby returning to Step 458 after the negative judgement of Step 465.

If the check result of Step 460 is found to be YES, Step 461 is undertaken to update the reading pointer to PPi+1 so as to read out a next sequence data SD(PTN, i, PPi+1) representative of a key code, which is then stored into the key code register KC. Since the pointer PPi designates an address of the timing data, the following pointer PPi+1 designates a next address of the associated key code data. In a next Step 462, the tone pitch of the basic key code held in the register KC is converted according to the root note ROOT and the chord type TYPE of the chord detected in Step 422 of the main routine. A new key code of the converted tone pitch is reserved in the same key code register KC. In a next Step 463, the header section HD or UHD is accessed to retrieve a tone color code TC(PTN, i) designated by the selected combination pattern number PTN and the designated part number i. The retrieved tone color code TC(PTN, i) is fed to the tone generator TG together with a key-on signal indicative of tone generation and the key code stored in the register KC. The musical tone generator TG operates according to these given data to generate a musical tone signal having the specified tone pitch and the tone color. This musical tone signal is sounded as the automatic accompaniment tone of the part Pi by means of the sound system SS. After Step 463, Step 464 is undertaken to update the reading pointer PPi by "2". Consequently, the updated reading pointer PPi+2 addresses a next timing data. Thereafter, the processing returns to Step 458. When the above tone generating process is completed for the respective parts P0, P1 and P2 composed of pitched tones, the variable register i reaches "3" in Step 459. Thus, the check result of Step 465 turns to YES, thereby advancing to Step 466 for carrying out the tone generation process of the rhythm part P3. In Step 466, the sequence data section is addressed in similar manner to Step 458 by the pointer PP3 to read out the sequence data SD(PTN, 3, PP3). Further, check is made as to if the retrieved sequence data SD indicates an end code. If YES, the processing returns to the main routine. On the other hand, if the check result of Step 466 is found to be NO, the addressed sequence data SD(PTN, 3, PP3) represents a timing data, because the timing data precedes to the percussion kind of data as shown in the data formed of FIG. 20A. In a next Step 467, check is made as to if the retrieved timing data coincides to the current count value of the tempo clock counter CLK. If NO, the processing returns to the timer interruption routine of FIG. 25. If YES, the read timing data coincides with the current accompaniment progression point to thereby proceed to Step 468. In this step, the reading pointer PP3 is incremented by "1" to address a next sequence data section SD of the rhythm part to read out a percussion kind written in the sequence data section SD(PTN, 3, PP3+1). The retrieved percussion kind is stored in the register RN.

In a next Step 469, the percussion instrument code stored in the register RN is fed to the musical tone generator TG together with a key-on signal. The tone generator TG generates a musical tone signal having a percussive tone color specified by the percussion instrument code. This musical tone signal is sounded as the automatic accompaniment tone of the rhythm part P3. After Step 469, the reading pointer PP3 is updated by "2" in Step 470. Consequently, the updated reading pointer PP3 designates a next timing data of a subsequent rhythm tone. Thereafter, the processing returns to Step 466 to repeat the same process. After the tone generating process of FIG. 26 is finished, the processing returns to the timer interruption routine of FIG. 25 to execute the process of Step 471. Namely, the tempo clock counter CLK is incremented by "1" to thereby return to the main routine.

In the above embodiment, the reading pointer is returned to the top address of a shorter part pattern to supplement a deficient beat; however, an intermediate or a last beat may be additionally reproduced for the adjustment to the standard beat number. Further, a rest may be added in place of a note as shown in FIG. 21 to establish the meter consistency of all the parts. In the above embodiment, the maximum beat number is selected as the standard beat number; however, the minimum beat number may be selected as the standard beat number. In such a case, a remaining beat exceeding the standard beat number may be eliminated for the meter adjustment like in the second embodiment. Alternatively, the user may select either of maximum and minimum beat numbers as the standard beat number. Otherwise, the user may set a desired standard beat number regardless of meters of respective parts of the free combination pattern. In the above described embodiment, each part of the free combination pattern is indirectly specified in terms of a desired preset combination pattern number; however, each preset part pattern may be assigned an identification code, and a desired part pattern is directly specified by the identification code. Further, various parts may be individually selected while the different meters thereof are adjusted concurrently, rather than selecting a preset or free combination pattern as a whole.

As described above, according to the invention, a shorter part of the free combination pattern is added with another note or rest to supplement a deficient beat. Therefore, various part patterns having different meters can be freely combined to form an orchestra accompaniment, thereby enhancing variety of the automatic accompaniment.

What is claimed is:

1. An apparatus for composing an accompaniment pattern comprising:

memory means for memorizing a plurality of original accompaniment patterns corresponding to various accompaniment styles, each original accompaniment pattern being composed of a set of parallel parts;

editor means for selecting different ones of the original accompaniment patterns and collecting therefrom a set of desired parts to compose a free accompaniment pattern which is different than the original accompaniment patterns;

means for storing the free accompaniment pattern; and production means for producing a consistent progression of the free accompaniment pattern stored in the means for storing.

2. An automatic accompaniment apparatus comprising:

memory means for memorizing a plurality of original accompaniment part patterns having various pattern lengths;

designating means for designating some of the original accompaniment part patterns to define a free accompaniment pattern which is a set of collective parallel part patterns;

reading means for reading out the set of the collective parallel part patterns from the memory means concurrently with each other so as to produce the free accompaniment pattern; and control means operative during production of the free accompaniment pattern for controlling the reading means to regulate the reading of the collective parallel part patterns having the different pattern lengths, according to a pattern length of a particular one of the collective parallel part patterns to thereby maintain consistent progression of the collective parallel part patterns.

3. An automatic accompaniment apparatus comprising:

first memory means for memorizing a plurality of original accompaniment patterns corresponding to various accompaniment styles and having various pattern lengths, each original accompaniment pattern being composed of a set of parallel parts having a common pattern length;

second memory means for memorizing a given prescription data effective to designate different ones of original accompaniment patterns and further effective to select therefrom a set of collective parallel parts having different pattern lengths to define a free accompaniment pattern;

reading means operative according to the prescription data for reading out the set of the collective parallel parts from the first memory means concurrently with each other in response to a given tempo clock so as to reproduce the free accompaniment pattern;

detecting means operative during reproduction of the free accompaniment pattern for detecting an end point of a particular one of the collective parallel parts;

control means operative when the end point is detected for controlling the reading means to reset reading of the respective parallel parts concurrently to each top point thereof to thereby repeat the reproduction of the free accompaniment pattern; and tone generating means for generating musical tones according to the reproduced free accompaniment pattern.

4. An automatic accompaniment apparatus comprising:

first memory means for memorizing a plurality of original accompaniment patterns corresponding to various accompaniment styles and having various pattern lengths, each original accompaniment pattern being composed of a set of parallel parts having a common pattern length;

second memory means for memorizing a prescription data effective to designate different ones of original accompaniment patterns and further effective to select therefrom a set of collective parallel parts having different pattern lengths to define a free accompaniment pattern;

reading means operative according to the prescription data for reading out the set of the collective parallel parts from the first memory means concurrently with each other in response to a given tempo clock so as to reproduce the free accompaniment pattern;

detecting means operative during reproduction of the free accompaniment pattern for detecting each end point of respective shorter parts which have a shorter pattern length than that of the longest part;

control means operative when each end point is detected for controlling the reading means to continue reading of a certain section of the respective shorter part until the longest part reaches an end point thereof to thereby complete concurrently all the collective parallel parts; and tone generating means for generating musical tones according to the reproduced free accompaniment pattern.

5. An automatic accompaniment apparatus comprising:

memory means for memorizing a plurality of original accompaniment part patterns having various meters;

designating means for designating some of the original accompaniment part patterns to define a free accompaniment pattern which is a set of collective parallel part patterns;

producing means for reading out the set of the collective parallel part patterns from the memory means concurrently so as to produce the free accompaniment pattern; and control means operative during production of the free accompaniment pattern for controlling the producing means to modify a beat sequence of the respective parallel part patterns having different meters to thereby establish a meter consistency of the produced free accompaniment pattern.

6. An automatic accompaniment apparatus according to claim 5; wherein the control means includes means for modifying the beat sequence of the respective parallel part patterns by either or both of adding a deficient beat and deleting an excessive beat based on a given meter specified for the free accompaniment pattern.

7. An automatic accompaniment apparatus comprising:

memory means for memorizing a plurality of original accompaniment part patterns having various meters;

designating means for designating some of the original accompaniment part patterns to define a free accompaniment pattern which is a set of collective parallel part patterns;

detecting means for detecting a maximum meter among the set of the collective parallel part patterns so as to determine a standard meter;

producing means for reading out the set of the collective parallel part patterns from the memory means concurrently so as to produce the free accompaniment pattern; and control means operative during production of the free accompaniment pattern for controlling the producing means to add either of a note or a rest into the respective parallel part patterns to supplement a deficient beat relative to the standard meter to thereby establish a meter consistency of the produced free accompaniment pattern.

8. An apparatus for composing a performance pattern of a given song comprising:

memory means for memorizing a plurality of original performance patterns;

editor means for serially selecting different original performance patterns to compose a free serial performance pattern of a given song, and for assigning a desired meter to the free serial performance pattern;

detecting means for detecting a meter inconsistency between the assigned meter and the various meter of each selected original performance pattern; and reading means for reading out the selected original performance patterns while skipping or repeating a certain note within each measure according to the detected meter inconsistency to thereby edit the free serial performance pattern consistently with the assigned meter.

9. An apparatus for composing a free arrangement of an accompaniment pattern comprising:

means for storing a plurality of original accompaniment patterns corresponding to various accompaniment styles and each being comprised of a set of parallel parts;

means for freely selecting desired ones of the original accompaniment patterns and assembling desired parts from the selected patterns to form a free arrangement accompaniment pattern;

means for storing the free arrangement accompaniment pattern; and means for reproducing the free arrangement accompaniment pattern and including means for correcting for differences in the lengths of the parts of the free arrangement accompaniment pattern to maintain a consistent progression of the free arrangement accompaniment pattern during reproduction thereof.

* * * * *